US009029310B2

(12) United States Patent
Maas et al.

(10) Patent No.: US 9,029,310 B2
(45) Date of Patent: May 12, 2015

(54) ENZYME COMPOSITION COMPRISING ENZYME CONTAINING POLYMER PARTICLES

(75) Inventors: Steffen Maas, Bubenheim (DE); Volker Schwendemann, Neustadt (DE); Lidcay Herrera Taboada, Barcelona (ES); Heike Pfistner, Ludwigshafen (DE); Dieter Boeckh, Limburgerhof (DE); Ole Simonsen, Seoborg (DK)

(73) Assignees: Basf Se, Ludwigshafen (DE); Novozymes A/S, Bagsvaerd (DK)

( * ) Notice: Subject to any disclaimer, the term of this patent is extended or adjusted under 35 U.S.C. 154(b) by 797 days.

(21) Appl. No.: 13/003,087

(22) PCT Filed: Jul. 7, 2009

(86) PCT No.: PCT/EP2009/058547

§ 371 (c)(1),
(2), (4) Date: Jan. 7, 2011

(87) PCT Pub. No.: WO2010/003934

PCT Pub. Date: Jan. 14, 2010

(65) Prior Publication Data

US 2011/0130318 A1 Jun. 2, 2011

(30) Foreign Application Priority Data

Jul. 7, 2008 (EP) ..... 08104659

(51) Int. Cl.

| | |
|---|---|
| ***C11D 3/02*** | (2006.01) |
| ***C11D 3/386*** | (2006.01) |
| ***C11D 3/37*** | (2006.01) |
| ***C11D 11/00*** | (2006.01) |

(52) U.S. Cl.

CPC ..... *C11D 3/38672* (2013.01); *C11D 3/3757* (2013.01); *C11D 3/3769* (2013.01); *C11D 3/38663* (2013.01); *C11D 11/0082* (2013.01)

(58) Field of Classification Search

USPC ..... 510/218

See application file for complete search history.

(56) References Cited

U.S. PATENT DOCUMENTS

| | | | | |
|---|---|---|---|---|
| 2,220,099 | A | 11/1940 | Guenther et al. | |
| 2,477,383 | A | 7/1949 | Lewis | |
| 3,594,325 | A | 7/1971 | Feierstein et al. | |
| 3,664,961 | A | 5/1972 | Norris | |
| 4,414,370 | A | 11/1983 | Hamielec et al. | |
| 4,435,307 | A | 3/1984 | Barbesgaard et al. | |
| 4,529,787 | A | 7/1985 | Schmidt et al. | |
| 4,546,160 | A | 10/1985 | Brand et al. | |
| 5,035,900 | A | 7/1991 | Langley et al. | |
| 5,198,353 | A | 3/1993 | Hawkins et al. | |
| 6,355,727 | B1 | 3/2002 | Andrist et al. | |
| 6,656,898 | B1 * | 12/2003 | Foley et al. | 510/393 |
| 6,858,678 | B2 | 2/2005 | Andrist et al. | |
| 2003/0125222 | A1 * | 7/2003 | Jahns et al. | 510/130 |

FOREIGN PATENT DOCUMENTS

| | | |
|---|---|---|
| DE | 37 30 885 | 3/1989 |
| DE | 39 26 168 | 2/1991 |
| DE | 39 31 039 | 3/1991 |
| DE | 44 02 029 | 7/1995 |
| DE | 198 10 404 | 9/1999 |
| DE | 102 51 141 | 5/2004 |
| EP | 0 070 077 | 1/1983 |
| EP | 0 075 996 | 4/1983 |
| EP | 0 094 118 | 11/1983 |
| EP | 0 214 761 | 3/1987 |
| EP | 0 218 272 | 4/1987 |
| EP | 0 238 023 | 9/1987 |
| EP | 0 238 216 | 9/1987 |
| EP | 0 251 446 | 1/1988 |
| EP | 0 258 068 | 3/1988 |
| EP | 0 305 216 | 3/1989 |
| EP | 0 331 376 | 9/1989 |
| EP | 0 356 239 | 2/1990 |
| EP | 0 356 240 | 2/1990 |
| EP | 0 412 389 | 2/1991 |
| EP | 0 495 257 | 7/1992 |
| EP | 0 498 634 | 8/1992 |
| EP | 0 525 610 | 2/1993 |
| GB | 1 123 846 | 8/1968 |
| GB | 1 296 839 | 11/1972 |
| GB | 1 353 317 | 5/1974 |
| GB | 1 415 301 | 11/1975 |
| GB | 2 200 377 | 8/1988 |
| WO | 88 09367 | 12/1988 |
| WO | 89 06270 | 7/1989 |
| WO | 89 06279 | 7/1989 |
| WO | 90 09446 | 8/1990 |
| WO | 91 00345 | 1/1991 |
| WO | 91 05858 | 5/1991 |
| WO | 91 16422 | 10/1991 |

(Continued)

OTHER PUBLICATIONS

International Search Report issued Sep. 4, 2009 in PCT/EP09/058547 filed Jul. 7, 2009.

*Primary Examiner* — Ling Choi
*Assistant Examiner* — Thuy-Ai Nguyen
(74) *Attorney, Agent, or Firm* — Oblon, McClelland, Maier & Neustadt, L.L.P.

(57) ABSTRACT

The present invention relates to an enzyme composition comprising enzyme containing polymer particles, which is useful for detergent compositions, in particular for liquid detergent compositions. In these enzyme containing particles, the particles comprise i) at least one enzyme, and ii) at least one polymer P, which is selected from homo- and copolymers having a C—C-backbone, wherein the C—C-backbone carries carboxylgroups, which may be present in the acidic form or in the neutralized form, and wherein the C—C-backbone comprises hydrophobic repeating units.

11 Claims, No Drawings

(56) References Cited

FOREIGN PATENT DOCUMENTS

| | | |
|---|---|---|
| WO | 92 19708 | 11/1992 |
| WO | 92 19709 | 11/1992 |
| WO | 93 22417 | 11/1993 |
| WO | 94 02618 | 2/1994 |
| WO | 96 06931 | 3/1996 |
| WO | 97 24179 | 7/1997 |
| WO | 98 28408 | 7/1998 |
| WO | 99 00478 | 1/1999 |
| WO | 00 43503 | 7/2000 |
| WO | 01 58275 | 8/2001 |
| WO | 01 58276 | 8/2001 |
| WO | 02 081616 | 10/2002 |
| WO | 02 096551 | 12/2002 |
| WO | 03 066847 | 8/2003 |
| WO | 2008 058921 | 5/2008 |

* cited by examiner

ENZYME COMPOSITION COMPRISING ENZYME CONTAINING POLYMER PARTICLES

This application is a National Stage of PCT/EP09/058547 filed Jul. 7, 2009 and claims the benefit of EP 08104659.1 filed Jul. 7, 2008.

The present invention relates to an enzyme composition comprising enzyme containing polymer particles, which is useful for detergent compositions, in particular for liquid detergent compositions.

The stability of enzymes is known to be influenced by the surrounding environment upon storage, as chemical or physical factors may decrease the stability of the enzyme. In particular, the stability of enzymes in liquid formulations comprising protein hostile compounds, such as liquid detergents, is problematic and it is difficult to keep the enzymes stable in such liquid formulations. A particular problem associtated with liquid detergents is that they usually contain proteolytic enzymes which digest proteins, thus other enzymes present in the liquid detergent might be inactivated by present proteases wherein both proteolysis and autoproteolysis might occur.

To use particles comprising a mixture of polymer and enzyme in liquid formulations instead of usual liquid enzyme products may have several advantages; it is possible to keep enzyme hostile compounds away from the enzyme until the activity of the enzyme is needed and it is possible to avoid the enzyme to be in direct contact with compounds in the liquid which activates the enzyme. However, the liquid formulations may become turbid after addition of enzyme containing polymer particles, due to the light scattering of the relatively large particles. It may also be of importance that the particles do not or only slightly change appearance of the liquid formulation after addition and that they have a decreased tendency to sediment. It may furthermore be of importance that the enzyme is released at the right time, e.g. for a liquid detergent that the enzyme is released upon contact with the wash water.

There have been several attempts to prepare enzyme compositions suitable for liquid formulations such as liquid detergents.

EP 356239 A2 and EP 356240 disclose enzyme containing polymer beads, which are prepared by removing water from a water-in-oil (w/o) emulsion of an aqueous solution of a water soluble polymer such as polyacrylic acid and an enzyme in a water immiscible liquid or by coacervation with formaldehyde and urea. The process for preparing the polymer particles is tedious and does not allow the preparation of small enzyme polymer particls. Apart from that, the stability of the enzyme is not satisfactory.

WO 93/22417 A1 describes polymer capsules comprising (a) a detergent sensitive ingredient such as a detergent enzyme and (b) a polymer composite comprising (i) a hydrophobic polymer core, formed by emulsion polymerization of ethylenically unsaturated monomers, and (ii) a hydrophilic polymer, selected from synthetic nonionic polymers, polysacharides, modified polysacharides, proteins, modified proteins, polymers bearing hydroxyl groups and polymers bearing carboxyl groups. The polymer composites, however, are difficult to prepare.

U.S. Pat. No. 5,198,353 describes a method for preparing a stabilized enzyme dispersion, which comprises precipitating a water-soluble polymer such as polyvinylalcohol, polyvinylpyrrolidone, carboxymethylcellulose, guar gum or polycarboxylic acid from an aqueous solution in the presence of the enzyme. The dispersion is suitable for enzymatic liquid detergents. However, the achieved stabilization is not entirely satisfactory.

WO 02/81616 A1 describes water-soluble or water-dispersible enzyme containing particles suitable for detergent compositions, wherein the enzyme is dispersed in a matrix comprising polyvinylalcohol. The particles are rather large and thus are difficult to incorporate into liquid detergent compositions.

WO 02/96551 A1 describes dissolvable nano- or microcapsules comprising colloidal template and polymer surrounding the template. The polymer is a polyampholyte, e.g. a protein having an isoelectric point preferably in the range of pH 4 to 9. It is suggested to use these capsules for encapsulating laundry detergents. The process for preparing the nano- or microcapsules is tedious and the polyampholytes are expensive.

Therefore it is an objective of the present invention to provide compositions for effectively stabilizing enzymes in liquid formulations comprising protein hostile compounds, such as liquid detergents. It is desirable that the compositions can be easily incorporated into liquid formulations, in particular into liquid detergent compositions. When incorporated into liquid formulations, the composition should not affect the appearance of the formulations. Moreover, the compositions should be easily contrivable.

It has surprisingly been found that these and further objectives are solved by compositions in the form of enzyme containing particles, wherein the particles comprise i) at least one enzyme, and ii) at least one polymer P, which is selected from homo- and copolymers having a C—C-backbone, wherein the C—C-backbone carries carboxylgroups, which may be present in the acidic form or in the neutralized form, and wherein the C—C-backbone comprises at least 20% by weight, e.g. from 20 to 98% by weight, based on the total weight of the polymer P (i.e. based on the total weight of repeating units in the polymer P), of hydrophobic repeating units derived from monomers B having a water solubility of at most 30 g/l at 25° C., wherein volume average particle diameter of the enzyme containing particles is from 50 nm to 100 μm.

Therefore, the present invention relates to enzyme compositions in the form of enzyme containing particles, wherein the particles comprise i) at least one enzyme, and ii) at least one polymer P as defined herein.

and wherein volume average particle diameter of the enzyme containing particles is from 50 nm to 100 μm.

The enzyme composition of the present invention has several advantages. The particles comprising a mixture of polymer P and enzyme improve storage stability of the enzyme(s) in liquid formulations such as detergents. The enzyme containing polymer particles can be easily produced from liquid enzyme preparations and furthermore the polymer P is commercially available or can be easily produced. As the particles are of small size they are practically invisible in the formulation and do not sediment. As the enzyme is present in the particles, the enzyme is not in direct contact with the environment and enzyme sensitive compounds in the surrounding environment such as the components of a liquid detergent are not in direct contact with the enzyme. Enzyme sensitive compounds could be lipids towards lipases or proteins towards proteases. Apart from that, the enzyme is rapidly released into the media where it is supposed to work. With regard to detergents it is important that the enzyme is released when the detergent is diluted by water during the wash process. This is ensured by the properties of the polymer P, which functions as a release system. Thus, the enzyme composition is suitable for incorporation into detergent compositions, in particular liquid detergent compositions. Therefore the invention also relates to detergent compositions, in particular liquid detergent compositions.

The enzyme composition of the invention contains at least one enzyme or an enzyme mixture.

The enzyme in the context of the present invention may be any enzyme or combination of different enzymes. Accordingly, when reference is made to "an enzyme" this will in general be understood to include one enzyme or a combination of enzymes. The enzyme may be any commercially available enzyme, in particular an enzyme selected from the group consisting of proteases, amylases, lipases, cellulases, lyases, oxidoreductases and any mixture thereof. Mixtures of enzymes from the same class (e.g. proteases) are also included.

The types of enzymes which may be preferably incorporated in composition of the invention include oxidoreductases (EC 1.-.-.-), transferases (EC 2.-.-.-), hydrolases (EC 3.-.-.-), lyases (EC 4.-.-.-), isomerases (EC 5.-.-.-) and ligases (EC 6.-.-.-) as well as mixtures thereof.

It is to be understood that enzyme variants (produced, for example, by recombinant techniques) are included within the meaning of the term "enzyme". Examples of such enzyme variants are disclosed, e.g. in EP 251,446 (Genencor), WO 91/00345 (Novo Nordisk), EP 525,610 (Solvay) and WO 94/02618 (Gist-Brocades NV).

Enzymes can be classified on the basis of the handbook Enzyme Nomenclature from NC-IUBMB, 1992), see also the ENZYME site at the internet: http://www.expasy.ch/enzyme/. ENZYME is a repository of information relative to the nomenclature of enzymes. It is primarily based on the recommendations of the Nomenclature Committee of the International Union of Biochemistry and Molecular Biology (IUB-MB), Academic Press, Inc., 1992, and it describes each type of characterized enzyme for which an EC (Enzyme Commission) number has been provided (Bairoch A. The ENZYME database, 2000, Nucleic Acids Res 28:304-305). This IUB-MB Enzyme nomenclature is based on their substrate specificity and occasionally on their molecular mechanism; such a classification does not reflect the structural features of these enzymes.

Another classification of certain glycoside hydrolase enzymes, such as endoglucanase, xylanase, galactanase, mannanase, dextranase and alpha-galactosidase, in families based on amino acid sequence similarities has been proposed a few years ago. They currently fall into 90 different families: See the CAZy(ModO) internet site (Coutinho, P. M. & Henrissat, B. (1999) Carbohydrate-Active Enzymes server at URL: http://afmb.cnrs-mrs.fr/~cazy/CAZY/index.html (corresponding papers: Coutinho, P. M. & Henrissat, B. (1999) Carbohydrate-active enzymes: an integrated database approach. In "Recent Advances in Carbohydrate Bioengineering", H. J. Gilbert, G. Davies, B. Henrissat and B. Svensson eds., The Royal Society of Chemistry, Cambridge, pp. 3-12; Coutinho, P. M. & Henrissat, B. (1999) The modular structure of cellulases and other carbohydrate-active enzymes: an integrated database approach. In "Genetics, Biochemistry and Ecology of Cellulose Degradation", K. Ohmiya, K. Hayashi, K. Sakka, Y. Kobayashi, S. Karita and T. Kimura eds., Uni Publishers Co., Tokyo, pp. 15-23).

Oxidoreductases: Any oxidoreductase suitable for use in a liquid composition, e.g., peroxidases or oxidases such as laccases, can be used herein. Suitable peroxidases herein include those of plant, bacterial or fungal origin. Chemically or genetically modified mutants are included. Examples of suitable peroxidases are those derived from a strain of *Coprinus*, e.g., *C. cinerius* or *C. macrorhizus*, or from a strain of *Bacillus*, e.g., *B. pumilus*, particularly peroxidase according to WO 91/05858. Suitable laccases herein include those of bacterial or fungal origin. Chemically or genetically modified mutants are included. Examples of suitable laccases are those obtainable from a strain of *Trametes*, e.g., *T. villosa* or *T. versicolor*, or from a strain of *Coprinus*, e.g., *C. cinereus*, or from a strain of *Myceliophthora*, e.g., *M. thermophila*.

Preferred oxidoreductases in the context of the invention are peroxidases (EC 1.11.1), laccases (EC 1.10.3.2) and glucose oxidases (EC 1.1.3.4)]. An Example of a commercially available oxidoreductase (EC 1.-.-.-) is Gluzyme® (enzyme available from Novozymes NS). Further oxidoreductases are available from other suppliers.

Preferred transferases are transferases in any of the following sub-classes:

a Transferases transferring one-carbon groups (EC 2.1);

b transferases transferring aldehyde or ketone residues (EC 2.2); acyltransferases (EC 2.3);

c glycosyltransferases (EC 2.4);

d transferases transferring alkyl or aryl groups, other that methyl groups (EC 2.5); and e transferases transferring nitrogeneous groups (EC 2.6).

A most preferred type of transferase in the context of the invention is a transglutaminase (protein-glutamine γ-glutamyltransferase; EC 2.3.2.13). Further examples of suitable transglutaminases are described in WO 96/06931 (Novo Nordisk NS).

Preferred hydrolases in the context of the invention are: esterases (EC 3.1), in particular carboxylic ester hydrolases (EC 3.1.1.-) such as triacylglycerol lipases (EC 3.1.1.3); phytases (EC 3.1.3.-), e.g. 3-phytases (EC 3.1.3.8) and 6-phytases (EC 3.1.3.26); glycosidases (EC 3.2, which fall within a group denoted herein as "carbohydrases"), such as α-amylases (EC 3.2.1.1), R-amylases (EC 3.2.1.2); peptidases (EC 3.4.-.-, also known as proteases); and other carbonyl hydrolases.

Proteases: Suitable proteases include those of animal, vegetable or microbial origin. Microbial origin is preferred. Chemically or genetically modified mutants are included. The protease may be a serine protease, preferably an alkaline microbial protease or a trypsin-like protease. Examples of alkaline proteases are subtilisins, especially those derived from *Bacillus*, e.g., subtilisin Novo, subtilisin Carlsberg, subtilisin 309, subtilisin 147 and subtilisin 168 (described in WO 89/06279). Examples of trypsin-like proteases are trypsin (e.g. of porcine or bovine origin) and the Fusarium protease described in WO 89/06270. In a particular embodiment of the present invention the protease is a serine protease. Serine proteases or serine endopeptidases (newer name) are a class of peptidases which are characterised by the presence of a serine residue in the active center of the enzyme.

Serine proteases: A serine protease is an enzyme which catalyzes the hydrolysis of peptide bonds, and in which there is an essential serine residue at the active site (White, Handler and Smith, 1973 "Principles of Biochemistry," Fifth Edition, McGraw-Hill Book Company, NY, pp. 271-272).

The bacterial serine proteases have molecular weights in the 20,000 to 45,000 Daltons range. They are inhibited by diisopropylfluorophosphate. They hydrolyze simple terminal esters and are similar in activity to eukaryotic chymotrypsin, also a serine protease. A more narrow term, alkaline protease, covering a sub group, reflects the high pH optimum of some of the serine proteases, from pH 9.0 to 11.0 (for review, see Priest (1977) Bacteriological Rev. 41 711-753).

Subtilases: A sub-group of the serine proteases tentatively designated subtilases has been proposed by Siezen et al. (1991), Protein Eng., 4 719-737. They are defined by homology analysis of more than 40 amino acid sequences of serine proteases previously referred to as subtilisin-like proteases. A subtilisin was previously defined as a serine protease produced by Gram-positive bacteria or fungi, and according to Siezen et al. now is a subgroup of the subtilases. A wide variety of subtilisins have been identified, and the amino acid sequence of a number of subtilisins have been determined. These include more than six subtilisins from *Bacillus* strains, namely, subtilisin 168, subtilisin BPN', subtilisin Carlsberg, subtilisin Y, subtilisin amylosacchariticus, and mesentericopeptidase (Kurihara et al. (1972) J. Biol. Chem. 247 5629-5631; Wells et al. (1983) Nucleic Acids Res. 11 7911-7925; Stahl and Ferrari (1984) J. Bacteriol. 159 811-819, Jacobs et al. (1985) Nucl. Acids Res. 13 8913-8926; Nedkov et al. (1985) Biol. Chem. Hoppe-Seyler 366 421-430, Svendsen et al. (1986) FEBS Lett. 196 228-232), one subtilisin from an actinomycetales, thermitase from *Thermoactinomyces vulgaris* (Meloun et al. (1985) FEBS Lett. 198 195-200), and one fungal subtilisin, proteinase K from *Tritirachium album* (Jany and Mayer (1985) Biol. Chem. Hoppe-Seyler 366 584-492). for further reference Table I from Siezen et al. has been reproduced below.

Subtilisins are well-characterized physically and chemically. In addition to knowledge of the primary structure (amino acid sequence) of these enzymes, over 50 high resolution X-ray structures of subtilisins have been determined which delineate the binding of substrate, transition state, products, at least three different protease inhibitors, and define the structural consequences for natural variation (Kraut (1977) Ann. Rev. Biochem. 46 331-358).

One subgroup of the subtilases, I-S1, comprises the "classical" subtilisins, such as subtilisin 168, subtilisin BPN', subtilisin Carlsberg (ALCALASE®, Novozymes NS), and subtilisin DY.

A further subgroup of the subtilases I-S2, is recognised by Siezen et al. (supra). Sub-group I-S2 proteases are described as highly alkaline subtilisins and comprise enzymes such as subtilisin PB92 (MAXACAL®, Gist-Brocades NV), subtilisin 309 (SAVINASE®, Novozymes NS), subtilisin 147 (ESPERASE®, Novozymes A/S), and alkaline elastase YaB.

Random and site-directed mutations of the subtilase gene have both arisen from knowledge of the physical and chemical properties of the enzyme and contributed information relating to subtilase's catalytic activity, substrate specificity, tertiary structure, etc. (Wells et al. (1987) Proc. Natl. Acad. Sci. U.S.A. 84; 1219-1223; Wells et al. (1986) Phil. Trans. R. Soc. Lond. A. 317 415-423; Hwang and Warshel (1987) Biochem. 26 2669-2673; Rao et al., (1987) Nature 328 551-554. More recent publications covering this area are Carter et al. (1989) Proteins 6 240-248 relating to design of variants that cleave a specific target sequence in a substrate (positions 24 and 64); Graycar et al. (1992) Annals of the New York Academy of Sciences 672 71-79 discussing a number of previously published results; and Takagi (1993) Int. J. Biochem. 25 307-312 also reviewing previous results.

Examples of commercially available proteases (peptidases) include Kannase™, Everlase™, Esperase™, Alcalase®, Neutrase®, Durazym®, Savinase®, Ovozyme®, Pyrase®, Pancreatic Trypsin NOVO (PTN), Bio-Feed® Pro and Clear-Lens® Pro (all available from Novozymes NS, Bagsvaerd, Denmark). Other preferred proteases include those described in WO 01/58275 and WO 01/58276.

Other commercially available proteases include Ronozyme® Pro, Maxatase®, Maxacal®, Maxapem®, Opticlean®, Propease®, Purafect®, and Purafect Ox® (available from Genencor International Inc., Gist-Brocades, BASF, or DSM Nutritional Products).

Examples of commercially available lipases include Lipex® Lipoprime®, Lipopan® Lipolase®, Lipolase®, Ultra, Lipozyme®, Palatase®, Resinase®, Novozym® 435 and Lecitase® (all available from Novozymes NS).

Lipases: Suitable lipases include those of bacterial or fungal origin. Chemically or genetically modified mutants are included.

Examples of useful lipases include a *Humicola lanuginosa* lipase, e.g., as described in EP 258 068 and EP 305 216, a *Rhizomucor miehei* lipase, e.g., as described in EP 238 023, a *Candida* lipase, such as a *C. antarctica* lipase, e.g., the *C. antarctica* lipase A or B described in EP 214 761, a *Pseudomonas* lipase such as a *P. pseudoalcaligenes* and *P. alcali*-genes lipase, e.g., as described in EP 218 272, a *P. cepacia* lipase, e.g., as described in EP 331 376, a *P. stutzerilipase*, e.g., as disclosed in BP 1,372,034, a *P. fluorescens* lipase, a *Bacillus* lipase, e.g., a *B. subtilis* lipase (Dar-tois et al., (1993), Biochemica et Biophysica acta 1131, 253-260), a *B. stearothermophilus* lipase (JP 64/744992) and a *B. pumilus* lipase (WO 91/16422).

Furthermore, a number of cloned lipases may be useful, including the *Penicillium camenbertii* lipase described by Ya-maguchi et al., (1991), Gene 103, 61-67), the *Geotricum can*-didum lipase (Schimada, Y. et al., (1989), J. Biochem. 106, 383-388), and various *Rhizopus* lipases such as a *R. delemar* lipase (Hass, M. J et al., (1991), Gene 109, 117-113), a *R. niveus* lipase (Kugimiya et al., (1992), Biosci. Biotech. Biochem. 56, 716-719) and a *R. oryzae* lipase.

Other types of lipolytic enzymes such as cutinases may also be useful, e.g., a cutinase derived from *Pseudomonas mendocina* as described in WO 88/09367, or a cutinase derived from *Fusarium solani* pisi (e.g. described in WO 90/09446).

Other commercially available lipases include Lumafast® (*Pseudomonas mendocina* lipase from Genencor International Inc.); Lipomax® (*Ps. pseudoalcaligenes* lipase from Gist-Brocades/Genencor Int. Inc.; and *Bacillus* sp. lipase from Solvay enzymes. Further lipases are available from other suppliers such as Lipase P "Amano" (Amano Pharmaceutical Co. Ltd.).

Amylases: Suitable amylases (α and/or β) include those of bacterial or fungal origin. Chemically or genetically modified mutants are included. Amylases include, for example, α-amylases obtained from a special strain of *B. licheniformis*, described in more detail in British Patent Specification No. 1,296,839. Commercially available amylases are Duramyl™, Termamyl™, FungamylT™ and BAN™ (available from Novozymes NS) and Rapidase™ and Maxamyl P™ (available from Gist-Brocades).

Cellulases: Suitable cellulases include those of bacterial or fungal origin. Chemically or genetically modified mutants are included. Suitable cellulases are disclosed in U.S. Pat. No. 4,435,307, which discloses fungal cellulases produced from Humicola insolens. Especially suitable cellulases are the cellulases having color care benefits. Examples of such cellulases are cellulases described in European patent application No. 0 495 257.

Examples of commercially available phytases include Bio-Feed™ Phytase (Novozymes), Ronozyme™ P (DSM Nutritional Products), Natuphos™ (BASF), Finase™ (AB Enzymes), and the Phyzyme™ product series (Danisco). Other preferred phytases include those described in WO 98/28408, WO 00/43503, and WO 03/066847.

In the present context, the term "carbohydrase" is used to denote not only enzymes capable of breaking down carbohydrate chains (e.g. starches or cellulose) of especially five- and six-membered ring structures (i.e. glycosidases, EC 3.2), but also enzymes capable of isomerizing carbohydrates, e.g. six-membered ring structures such as D-glucose to five-membered ring structures such as D-fructose.

Carbohydrases of relevance include the following (EC numbers in parentheses): α-amylases (EC 3.2.1.1), β-amylases (EC 3.2.1.2), glucan 1,4-α-glucosidases (EC 3.2.1.3), endo-1,4-beta-glucanase (cellulases, EC 3.2.1.4), endo-1,3(4)-β-glucanases (EC 3.2.1.6), endo-1,4-β-xylanases (EC 3.2.1.8), dextranases (EC 3.2.1.11), chitinases (EC 3.2.1.14), polygalacturonases (EC 3.2.1.15), lysozymes (EC 3.2.1.17), β-glucosidases (EC 3.2.1.21), α-galactosidases (EC 3.2.1.22), β-galactosidases (EC 3.2.1.23), amylo-1,6-glucosidases (EC 3.2.1.33), xylan 1,4-β-xylosidases (EC 3.2.1.37), glucan endo-1,3-β-D-glucosidases (EC 3.2.1.39), α-dextrin endo-1,6-α-glucosidases (EC 3.2.1.41), sucrose α-glucosidases (EC 3.2.1.48), glucan endo-1,3-α-glucosidases (EC 3.2.1.59), glucan 1,4-β-glucosidases (EC 3.2.1.74), glucan endo-1,6-β-glucosidases (EC 3.2.1.75), galactanases (EC 3.2.1.89), arabinan endo-1,5-α-L-arabinosidases (EC 3.2.1.99), lactases (EC 3.2.1.108), chitosanases (EC 3.2.1.132) and xylose isomerases (EC 5.3.1.5).

Examples of commercially available carbohydrases include Alpha-Gal®, Bio-Feed® Alpha, Bio-Feed® Beta, Bio-Feed® Plus, Bio-Feed® Wheat, Bio-Feed® Z, Novozyme® 188, Carezyme®, Celluclast®, Cellusoft®, Celluzyme®, Ceremyl®, Citrozym®, Denimax®, Dezyme®, Dextrozyme®, Duramyl®, Energex®, Finizym®, Fungamyl®, Gamanase®, Glucanex®, Lactozym®, Liguezyme®, Maltogenase®, Natelase®, Pentopan®, Pectinex®, Promozyme®, Pulpzyme®, Novamyl®, Termamyl®, AMG® (Amyloglucosidase Novo), Maltogenase®, Sweetzyme® and Aquazym® (all available from Novozymes NS). Further carbohydrases are available from other suppliers, such as the Roxazyme® and Ronozyme®, product series (DSM Nutritional Products), the Avizyme®, Porzyme®, and Grindazyme®, product series (Danisco, Finnfeeds), and Natugrain®, (BASF) , Purastar® and Purastar® OxAm (Genencor).

Other commercially available enzymes include Mannaway®, Pectaway®, Stainzyme® and Renozyme®.

The compostion of the invention preferably comprises a protease (EC 3.4.-.-), in particular a serine protease. In a particular embodiment a composition comprising two or more enzymes in which the first enzyme is a protease and the second enzyme is selected from the group consisting of glucosidases (EC 3.2.-.-), in particular amylases (EC 3.2.1.1 and 3.2.1.2) and cellulases (3.2.1.4), carboxylic ester hydrolases (E.C. 3.1.-.-) such as lipases (EC 3.1.1.-), in particular triacylglycerol lipases (EC 3.1.1.3), lyases and oxidoreductases. In a more particular embodiment the second enzyme is a lipase, in particular triacylglycerol lipase.

The enzyme containing particles comprise at least one polymer P as defined herein. The polymer P has a C—C-backbone which carries carboxyl groups (COOH) and which includes hydrophobic repeating units that are derived from monomers B having a water solubility of at most 30 g/l, preferably at most 10 g/l, in particular at most 5 g/l and especially at most 1 g/l at 25° C. Preferably, the polymer P is the only synthetic polymer present in the composition or in the enzyme containing particles or amounts to at least 90% by weight of the total weight of synthetic polymers present in the composition and thus in the enzyme containing particles.

The carboxyl groups in the polymer P may be attached to the polymer backbone directly, i.e. via a single bond, or via a bivalent radical such as a $C_1$-$C_4$-alkylene moiety (e.g. $CH_2$ or $CH_2$—$CH_2$) or a moiety of the formula —C(O)O-Alk-, wherein Alk is linear or branched $C_2$-$C_4$-alkylene such as 1,2-ethandiyl, 1,3-propandiyl, 1,4-butandiyl, 2-methylpropan-1,2-diyland wherein the carbonyl group is attached to the polymer backbone. Preferably, the carboxyl groups are attached directly to the C—C-backbone.

The carboxyl groups may be present in the acidic form (COOH) or in the neutralized form, i.e. in the anionic form. The polymer P then comprises counterions serving for electro neutrality of the polymer. Suitable counter ions include alkalimetal ions such as sodium or potassium ions, $NH_4^+$ and organic ammonium ions such as mono-, di-, tri- and tetraalkylammonium, wherein the each alkyl moieties may have from 1 to 40 carbon atoms and preferably in total from 1 to 40 carbon atoms, and wherein the alkyl moieties may be unsubstituted or substituted by a hydroxyl group or a NRR'-group, wherein R and R' are each independently selected form hydrogen or $C_1$-$C_4$-alkyl, and wherein the alkyl moieties having from 1 to 40 carbon atoms may be interrupted by one or more, i.e. 1, 2, 3, 4, 5 or 6 non-adjacent oxygen atoms.

The amount of carboxyl groups will generally be chosen that the acid number, i.e. the total number of neutralizable carboxyl groups is from 10 to 700 mg KOH per gram of polymer P, in particular from 30 to 600 mg KOH per gram of polymer P or from 50 to 500 mg KOH per gram of polymer P.

It is clear to a skilled person, that the C—C-backbone of the polymer P will be generally formed by C—C-repeating which correspond to polymerized monomers having a polymerizable C═C-double bond. Upon polymerization of the monomers that form the polymer P, the polymerized C═C-double bonds of the monomers form the C—C-backbone of the polymer P. Thus, the repeating units in the polymer P will generally correspond to the monomers polymerized when preparing the polymer P. Thus, the terms "repeating units", "units of polymerized monomers", "units derived from monomers" and "repeating units derived from (polymerized) monomers" as used herein are synonyms.

The carboxyl groups are usually part of polymerized monomers A forming (a certain part of) the C—C-backbone of the polymer P, i.e. the carboxyl groups are part of those repeating units of the C—C-backbone of the polymer P, which are derived from the monomers A. These monomers A are generally monoethylenically unsaturated and carry at least one carboxyl group. Suitable monomers A include monoethylenically unsaturated monocarboxylic acids having from 3 to 8 carbon atoms such as acrylic acid, methacrylic acid, crotonic acid, 2-vinylacetic acid, esters of acrylic acid or methacrylic acid with glycolic acid. Suitable monomers A also include monoethylenically unsaturated dicarboxylic acids having from 4 to 8 carbon atoms such as fumaric acid, maleic acid, itaconic acid and citraconic acid. The monomers A may also include mixtures of the aforementioned monomers.

A skilled person will readily appreciate, that in the preparation of the polymers P, instead of the aforementioned carboxylic acid monomers A or in combination therewith, the corresponding anhydrides such as acrylic acid anhydride, methacrylic acid anhydride, maleic acid anhydride or itaconic acid anhydride can be used. In this case, the primarily obtained polymer will be subjected to a hydrolysis, in order to convert the anhydride groups into carboxyl groups.

The amount of monomers A in the polymer P is generally from 2 to 80% by weight, preferably from 3 to 70% by weight, in particular from 5 to 60% by weight, based on , the total weight of repeating units in the polymer P which corresponds to the total weight of the polymer P.

The C—C-backbone of the polymer P also includes hydrophobic repeating units derived from the monomers B, i.e. the polymerized monomers B form another part of the repeating units of the C—C-backbone of the polymer P. In combination with the carboxyl groups the repeating units derived from the monomers B render the polymer P amphiphilic.

The hydrophobic repeating units may be hydrocarbon repeating units which generally have from 2 to 200, in particular from 2 to 100 and more preferably from 2 to 50 carbon atoms, including the 2 carbon atoms forming the C—C-backbone.

The hydrophobic repeating units may also be repeating units which comprise at least one heteroatom (e.g. 1, 2, 3 or 4 heteroatoms), which is (are) preferably selected from O and N and at least one nonpolymerizable hydrocarbon radical having at least 1, in particular at least 2 carbon atoms, e.g. from 1 to 200, in particular from 2 to 100 and more preferably from 2 to 50 carbon atoms. In this case, the hydrocarbon moiety is bound to the C—C-backbone of the polymer via a heteroatom moiety such as O, N, C(O)O(=carboxyl), C(O)N (carboxamid) or C(O)NC(O) (cyclic or acyclic carboximid). The nonpolymerizable hydrocarbon radical may be linear or branched alkyl having from 1 to 200 carbon atoms, preferably from 2 to 100 carbon atoms, in particular from 2 to 50 carbon, cycloalkyl having from 5 to 10 carbon atoms, which is optionally substituted by 1, 2, 3 alkyl radicals having from 1 to 20 carbon atoms and aryl such as phenyl or naphthyl, which is optionally substituted by 1, 2, 3 alkyl radicals having from 1 to 20 carbon atoms.

The term $C_n$-$C_m$, as used herein, indicates the number of carbon atom in the respective radical.

The term "alkyl", as used herein, refers to linear or branched alkyl radicals, including $C_1$-$C_{20}$ alkyl such as methyl, ethyl, propyl, isopropyl, n-butyl, 2-butyl, tert.-butyl, n-hexyl, n-heptyl, n-octyl, 1,1,3,3-tetramethylbutyl, 2-ethylhexyl, nonyl, n-decyl dodecyl, tridecyl, tetradecyl, pentadecyl, hexadecyl, heptadecyl, octadecyl, eicosyl, docosyl, lignoceryl, melissinyl, etc.

The amount hydrophobic repeating units in the polymer P is at least 20% by weight, preferably at least 30% by weight, in particular at least 40% by weight, based on the total weight of repeating units in the polymer P (corresponding to the total weight of the polymer P). The amount hydrophobic repeating units in the polymer P will generally be from 20 to 98% by weight, preferably from 30 to 97% by weight and in particular from 40 to 95% by weight, of the total weight of polymer P.

The hydrophobic repeating units are derived from polymerized hydrophobic monomers B. Hydrophobic monomers B have a reduced water solubility which generally does not exceed 30 g/l at 25° C. In particular the water solubility of the hydrophobic monomers B does not exceed 10 g/l, in particular 5 g/l and especially 1 g/l at 25 ° C. The hydrophobic monomers B may be practically insoluble in water (i.e. the solubility is below the limit of detection) or have a water solubility of at least $10^{-5}$ g/l at 25° C.

These hydrophobic monomers B are generally selected from the group consisting of monoethylenically unsaturated hydrocarbon monomers having at least 2 carbon atoms and monoethylenically unsaturated non-ionic monomers having a polymerizable C=C-double bond, at least one heteroatom (e.g. 1, 2, 3 or 4 heteroatoms), which is (are) preferably selected from O and N, and at least one non-polymerizable hydrocarbon radical which has at least 1, in particular at least 2 carbon atoms, e.g. from 1 to 200 carbon atoms, in particular from 2 to 100 carbon atoms or from 3 to 100 carbon atoms and more preferably from 2 to 50 carbon atoms or from 3 to 50 carbon atoms as defined above. The hydrophobic monomers may also be selected from monoethylenically unsaturated monomers having carboxyl group and at least one non-polymerizable hydrocarbon radical having at least 2, in particular at least 4 carbon atoms, e.g. from 2 to 200, in particular from 4 to 100 and more preferably from 4 to 50 carbon atoms as defined above. Of course, the monomers B can also be selected from mixtures of at least one hydrocarbon monomer with at least one further monomer selected from the aforementioned monoethylenically unsaturated, non-ionic monomers having at least one heteroatom and from the aforementioned monoethylenically unsaturated monomers having carboxyl group and at least one non-polymerizable hydrocarbon radical.

Suitable hydrocarbon monomers comprise one polymerizable C—C-double bond, which forms part of the C—C-backbone and optionally one or more, e.g. 1 or 2 further hydrocarbon radicals such as linear or branched alkyl having preferably from 1 to 98 carbon atoms, in particular form 1 to 48 carbon atoms.

Suitable hydrocarbon monomers include olefins, in particular α-olefins having preferably from 2 to 100 carbon atoms, in particular form 2 to 50, examples including ethylene, propen, 1-butene, 2-butene, isobutene, 1-pentene, 1-hexene, 1-heptene, 1-octene, diisobuten (=2-methyl-4,4-dimethyl-1-pentene), 1-nonene, 1-decene, 1-undecene, 1-dodecene, 1-tetradecene, 1-hexadecene, 1-octadecene, 1-eicosene, 1-docosene, 1-tetracosene, 1-heoxacosene, 1-octacosene and mixtures thereof, in particular technical mixtures of $C_{12}$-α-olefines, $C_{16}$-α-olefines, $C_{18}$-α-olefines, $C_{20-24}$-α-olefines and $C_{18-24}$-α-olefines and also oligomers of $C_4$-$C_{10}$-olefins having a polymerizable double bond, in particular a vinyl or vinyliden double bond, examples for oligomers including oligobutens and oligoisobutens having a molecular weight (number average) from 140 to 2000 dalton, in particular from . Suitable hydrocarbon monomers include vinylaromatic monomers such as styrene α-methylstyrene, and substituted styrenes such as 2-methylstyrene, 4-methylstyrene, 2-(n-butyl)styrene, 4-(n-butyl)styrene, 2-(tert-butyl)styrene, 4-(tert-butyl)styrene, 2-(n-decyl)styrene and 2-(n-decyl)styrene.

Suitable non-ionic monoethylenically unsaturated monomers having at least one heteroatom, which is preferably selected from O and N, and at least one non-polymerizable hydrocarbon radical which has at least 1, in particular at least 2 carbon atoms, include:

- $C_2$-$C_{50}$-alkylesters of $C_3$-$C_8$-monocarboxylic acids, in particular esters of acrylic acid or methacrylic acid such as ethyl(meth)acrylate, n-propyl(meth)acrylate, isopropyl (meth)acrylate, n-butyl(meth)acrylate, sec.-butyl(meth) acrylate, tert.-butyl(meth)acrylate, n-hexyl(meth)acrylate, n-heptyl (meth)acrylate, n-octyl(meth)acrylate, 1,1,3,3-tetramethylbutyl(meth)acrylate, 2-ethylhexyl (meth)acrylate, n-nonyl(meth)acrylate, n-decyl(meth) acrylate, n-undecyl(meth)acrylate, tridecyl(meth)acrylate, myristyl(meth)acrylate, pentadecyl(meth)acrylate, palmityl(meth)acrylate, heptadecyl(meth)acrylate, nonadecyl(meth)acrylate, arachinyl(meth)acrylate, behenyl(meth)acrylate, lignoceryl(meth)acrylate, cerotinyl(meth)acrylate, melissinyl(meth)acrylate, stearyl(meth)acrylat, lauryl(meth)acrylate;
- bis-$C_1$-$C_{50}$-alkylesters of $C_4$-$C_8$-dicarboxylic acids, in particular esters of fumaric acid, maleic acid or itaconic acid such as dimethyl maleinate, dimethylfumarate, dibutyl maleinate, dibutyl fumarate, dihexylmaleinate, dihexylfumarate, dioctylmaleinate and dioctylfumarate,
- N—$C_2$-$C_{50}$-alkylamides of $C_3$-$C_8$-monocarboxylic acids, in particular N-alkylamides of acrylic acid or methacrylic acid such as N-ethyl(meth)acrylamide, N-n-propyl(meth)acrylamide, N-isopropyl(meth)acrylamide, N-n-butyl (meth)acrylamide, N-sec.-butyl (meth)acrylamide, N-tert.-butyl(meth)acrylamide, N-n-hexyl (meth)acrylamide, N-n-heptyl(meth)acrylamide, N-n-octyl (meth)acrylamide, N-1,1,3,3-tetramethylbutyl (meth)acrylamide, N-2-ethylhexyl(meth)acrylamide, N-n-nonyl(meth)acrylamide, N-n-decyl (meth)acrylamide, N-n-undecyl(meth)acrylamide, N-tridecyl(meth) acrylamide, N-myristyl(meth)acrylamide, N-pentadecyl(meth)acrylamide, N-palmityl(meth)acrylamide, N-heptadecyl(meth)acrylamide, N-nonadecyl(meth) acrylamide, N-arachinyl(meth)acrylamide, N-behenyl (meth)acrylamide, N-lignoceryl(meth)acrylamide, N-cerotinyl(meth)acrylamide, N-melissinyl(meth)acrylamide, N-stearyl(meth)acrylat, N-lauryl(meth)acrylamide;

N—$C_1$-$C_{50}$-alkyl-N—$C_1$-$C_{50}$-alkylamides of $C_3$-$C_8$-monocarboxylic acids in particular N-alkyl-N-alkylamides of acrylic acid or methacrylic acid such as N-methyl-N-ethyl(meth)acrylamide, N-methyl-N-n-propyl (meth)acrylamide, N-methyl-N-isopropyl(meth) acrylamide, N-methyl-N-n-butyl(meth)acrylamide, N-methyl-N-sec.-butyl(meth)acrylamide, N-methyl-N-tert.-butyl(meth)acrylamide, N-methyl-N-n-hexyl (meth)acrylamide, N-methyl-N-n-heptyl(meth)acrylamide, N-methyl-N-n-octyl (meth)acrylamide, N-methyl-N-1,1,3,3-tetramethylbutyl(meth)acrylamide, N-methyl-N-2-ethylhexyl(meth)acrylamide, N-methyl-N-n-nonyl(meth)acrylamide, N-methyl-N-n-decyl(meth)acrylamide, N-methyl-N-n-undecyl(meth) acrylamide, N-methyl-N-tridecyl(meth)acrylamide, N-methyl-N-myristyl(meth)acrylamide, N-methyl-N-pentadecyl(meth)acrylamide, N-methyl-N-palmityl (meth)acrylamide, N-methyl-N-heptadecyl(meth)acrylamide, N-methyl-N-nonadecyl(meth)acrylamide, N-methyl-N-arachinyl(meth)acrylamide, N-methyl-N-behenyl(meth)acrylamide, N-methyl-N-lignoceryl (meth)acrylamide, N-methyl-N-cerotinyl(meth)acrylamide, N-methyl-N-melissinyl(meth)acrylamide, N-methyl-N-stearyl(meth)acrylat, N-methyl-N-lauryl (meth)acrylamide;

vinylesters of $C_2$-$C_{50}$-alkanoic acids, such as vinyl acetate, vinyl propionate, vinyl butyrate, vinyl pivalate, vinyl laurate, vinyl myristate, vinyl stearate and vinyl versatic esters;

vinyl-$C_1$-$C_{40}$-alkylethers such as methyl vinylether, ethyl vinylether, propyl vinylether, isopropyl vinylether, n-butyl vinylether, 2-butyl vinylether, tert.-butyl vinylether, n-hexyl vinylether, n-hepyl vinylether, n-octyl vinylether, 1,1,3,3-tetramethylbutyl vinylether, 2-ethylhexyl vinylether, nonyl vinylether, n-decyl dodecyl vinylether, tridecyl vinylether, tetradecyl vinylether, pentadecyl vinylether, hexadecyl vinylether, heptadecyl vinylether, octadecyl vinylether, eicosyl vinylether, docosyl vinylether, lignoceryl vinylether, melissinyl vinylether;

N—$C_1$-$C_{40}$-alkylimides of maleic acid such as N-methyl maleimide, N-ethyl maleimide, N-propyl maleimide, N-isopropyl maleimide, N-n-butyl maleimide, N-2-butyl maleimide, N-tert.-butyl maleimide, N-n-hexyl maleimide, N-n-hepyl maleimide, N-n-octyl maleimide, N-1,1,3,3-tetramethylbutyl maleimide, N-2-ethylhexyl maleimide, N-nonyl maleimide, N-n-decyl maleimide, N-dodecyl maleimide, N-tridecyl maleimide, N-tetradecyl maleimide, N-pentadecyl maleimide, N-hexadecyl maleimide, N-heptadecyl maleimide, N-octadecyl maleimide, N-eicosyl maleimide, N-docosyl maleimide, N-lignoceryl maleimide, N-melissinyl maleimide;

and mixtures thereof.

Suitable monoethylenically unsaturated monomers having a carboxyl group and at least one non-polymerizable hydrocarbon radical having at least 2, in particular at least 4 carbon atoms, e.g. from 2 to 200, in particular from 4 to 100 and more preferably from 4 to 50 carbon atoms, include e.g. the monoesters of monoethylenically unsaturated $C_4$-$C_8$-dicarboxylic acids, e.g. monoesters of maleic acid or fumaric acid with alkanols, and monocarboxamides of monoethylenically unsaturated $C_4$-$C_8$-dicarboxylic acids, e.g. monocarboxamides of maleic acid or fumaric acid with alkylamines or dialkylamines. Examples include particular the monoesters of maleic acid or fumaric acid with $C_2$-$C_{40}$-alkanols such as mono-n-butyl maleinate, mono-2-butyl maleinate, mono-n-hexyl maleinate, mono-n-hepyl maleinate, mono-n-octyl maleinate, mono-1,1,3,3-tetramethylbutyl maleinate, mono-2-ethylhexyl maleinate, mono-nonyl maleinate, mono-n-decyl maleinate, mono-dodecyl maleinate, mono-tridecyl maleinate, mono-tetradecyl maleinate, mono-pentadecyl maleinate, mono-hexadecyl maleinate, mono-heptadecyl maleinate, mono-octadecyl maleinate, mono-eicosyl maleinate, mono-docosyl maleinate, mono-n-butyl fumarate, mono-2-butyl fumarate, mono-n-hexyl fumarate, mono-n-hepyl fumarate, mono-n-octyl fumarate, mono-1,1,3,3-tetramethylbutyl fumarate, mono-2-ethylhexyl fumarate, mono-nonyl fumarate, mono-n-decyl fumarate, mono-dodecyl fumarate, mono-tridecyl fumarate, mono-tetradecyl fumarate, mono-pentadecyl fumarate, mono-hexadecyl fumarate, mono-heptadecyl fumarate, mono-octadecyl fumarate, mono-eicosyl fumarate and mono-docosyl fumarate, as well as monocarboxamides of maleic acid or fumaric acid with $C_2$-$C_{40}$-alkylamines or di-$C_1$-$C_{40}$-alkylamines.

The polymers P may also contain further polymerized units of monomers C, which are different from the aforementioned monomers A and B. Suitable further monomers C include monoethylenically unsaturated monomers, which are preferably neutral and which preferably have an increased water solubility which is usually greater than 50 g/l at 25° C. Suitable monomers C include acrylonitrile, methacrylonitrile, methylacrylate, hydroxy-$C_2$-$C_4$-alkyl esters of monoethylenically unsaturated mono- and di-$C_3$-$C_8$-carboxylic acids, in particular the hydroxy-$C_2$-$C_4$-alkyl esters of acrylic acid and of methacrylic acid, such as 2-hydroxyethyl acrylate, 3-hydroxypropyl acrylate, 2-hydroxypropyl acrylate, 4-hydroxybutyl acrylate, 2-hydroxyethyl methacrylate, 3-hydroxypropyl methacrylate, 2-hydroxypropyl methacrylate and 4-hydroxybutyl methacrylate;

N-vinyllactams, in particular those with 5 to 8 ring atoms, such as N-vinyl-pyrrolidone, N-vinylpiperidone, N-vinylmorpholinone and N-vinylcaprolactam, N-vinylamides of aliphatic carboxylic acid having 1 to 6 and in particular 1 to 4 carbon atoms, such as N-vinylformamide, N-vinylacetamide and N-vinyl-propionamide;

amides, hydroxy-$C_1$-$C_4$-alkylamides and $C_1$-$C_4$-alkyloxy-$C_1$-$C_4$-alkylamides of monoethylenically unsaturated $C_3$-$C_8$-monocarboxylic acids, such as acrylamide; methacrylamide, N-(methoxymethyl)(meth)acrylamide, N-(ethoxymethyl)-(meth)acrylamide, N-(2-methoxyethyl)(meth)acrylamide, N-(2-ethoxyethyl)-(meth)acrylamide and the like;

monoethylenically unsaturated monomers with polyether groups, in particular with poly-$C_2$-$C_4$-alkylene oxide groups, especially with polyethylenoxide groups, where the polyether groups preferably have a molecular weight (number average) in the range from 100 to 5000. These include, in particular, the vinyl and allyl ethers of poly- $C_2$-$C_4$-alkylene glycols, and the mono- and diesters of monoethylenically unsaturated $C_3$-$C_8$-mono- and $C_4$-$C_8$-dicarboxylic acids with poly-$C_2$-$C_4$-alkylene glycols, in particular the acrylic and the methacrylic monoesters of such poly-$C_2$-$C_4$-alkylene glycols.

The amount of polymerized units of monomers C will generally not exceed 20% by weight, in particular not exceed 10% be weight, based on the weight of the polymer P.

In a preferred embodiment of the invention, the polymer P is a copolymer comprising polymerized units (i.e. repeating units) A of at least one monoethylenically unsaturated monomer A having one or more carboxyl groups as defined above and polymerized units (i.e. repeating units) B of at least one hydrophobic monomer B as defined above. In the preferred polymers P, the molar ratio of polymerized units A to polymerised units B, and thus the molar ratio of polymerized monomers A to polymerized monomers B is generally from 1:20 to 10:1, preferably from 1:20 to 5:1, in particular from 1:15 to 5:1, especially from 1:10 to 2:1. In the preferred polymers P, the weight ratio of polymerized units A to polymerised units B, and thus the weight ratio of polymerized monomers A to polymerized monomers B is generally from 2:98 to 80:20, in particular from 3:97 to 70:30 and more preferably from 5:95 to 60:40. Preferably the total amount of polymerized units A and polymerised units B, and thus the total amount of polymerized monomers A and polymerized monomers B make up at least 80% by weight, in particular at least 90% by weight and more preferably at least 95% by weight of the polymer P. Particularly preferably, the polymerized monomers A and polymerized monomers B together make up at least 99% by weight of the polymer P or they are the only monomers forming the polymer P. Especially preferred polymers P essentially consist of repeating units A and B.

The polymerized units A are generally selected from repeating units derived from monoethylenically unsaturated $C_3$-$C_8$-monocarboxylic acids such as acrylic acid, methacrylic acid, crotonic acid, 2-vinylacetic acid, esters of acrylic acid or methacrylic acid with glycolic acid and monoethylenically unsaturated $C_3$-$C_8$-dicarboxylic acids such as fumaric acid, maleic acid, itaconic acid and citraconic acid. Preferred monomers A are selected from acrylic acid, methacrylic acid, maleic acid, itaconic acid and crotonic, and in particular from acrylic acid, methacrylic acid and maleic acid. A skilled person will readily appreciate, that in the preparation of the polymers P, instead of the aforementioned carboxylic acid monomers A or in combination therewith, the corresponding anhydrides such as acrylic acid anhydride, methacrylic acid anhydride, maleic acid anhydride or itaconic acid anhydride can be used. In this case, the primarily obtained polymer will be subjected to a hydrolysis, in order to convert the anhydride groups into carboxyl groups.

The monomers B are as defined above. Preferably the monomers B are selected from $C_2$-$C_{50}$-olefins, vinylaromatic compounds, $C_2$-$C_{50}$-alkylesters of $C_3$-$C_8$-monocarboxylic acids, bis-$C_1$-$C_{50}$-alkylesters of $C_4$-$C_8$-dicarboxylic acids, N—$C_2$-$C_{50}$-alkylamides of $C_3$-$C_8$-monocarboxylic acids, N—$C_1$-$C_{50}$-alkyl-N—$C_1$-$C_{50}$-alkylamides of $C_3$-$C_8$-monocarboxylic acids and vinylesters of $C_2$-$C_{50}$-alkanoic acids, vinyl-$C_1$-$C_{40}$-alkylethers, N-$C_1$-$C_{40}$-alkylimides of maleic acid and mixtures thereof. In particular, the monomers B are selected from $C_2$-$C_{50}$-olefins, vinylaromatic compounds, $C_2$-$C_{50}$-alkylesters of $C_3$-$C_8$-monocarboxylic acids, N—$C_2$-$C_{50}$-alkylamides of $C_3$-$C_8$-monocarboxylic acids and vinylesters of $C_2$-$C_{50}$-alkanoic acids.

Preferably the monomers B comprise at least one $C_2$-$C_{50}$-olefin, optionally in combination with at least one further monomer B, selected from vinylaromatic compounds, $C_2$-$C_{50}$-alkylesters of $C_3$-$C_8$-monocarboxylic acids, bis-$C_1$-$C_{50}$-alkylesters of $C_4$-$C_8$-dicarboxylic acids, N—$C_2$-$C_{50}$-alkylamides of $C_3$-$C_8$-monocarboxylic acids, N—$C_1$-$C_{50}$-alkyl-N—$C_1$-$C_{50}$-alkylamides of $C_3$-$C_8$-monocarboxylic acids, vinylesters of $C_2$-$C_{50}$-alkanoic acids, vinyl-$C_1$-$C_{40}$-alkylethers, N—$C_1$-$C_{40}$-alkylimides of maleic acid and mixtures thereof, in particular at least one $C_2$-$C_{50}$-olefin, optionally in combination with at least one further monomer B, selected from vinylaromatic compounds and $C_2$-$C_{50}$-alkylesters of $C_3$-$C_8$-monocarboxylic acids. In the polymers P, where the monomers B comprise at least one $C_2$-$C_{50}$-olefin, the amount of $C_2$-$C_{50}$-olefin is preferably at least 50 mol-%, in particular at least 70 mol-% or at least 80 mol-% of the total amount polymerized units (or monomers) B. If other monomers B are present, they will generally not exceed 50 mol-%, in particular 30 mol-% or 20 mol-% of the total amount polymerized units (or monomers) B. In the mixtures, the amount of ethylenically unsaturated monomers B different from $C_2$-$C_{50}$-olefin is e.g. from 0.5 to 50 mol-%, in particular from 1 to 30 mol-%, especially from 2 to 20 mol-% of the total amount polymerized units (or monomers) B. Preferably, the one ore more $C_2$-$C_{50}$-olefins are the only monomer B or amounts to at least 99 mol-% of the total amount polymerized units (or monomers) B.

In a first particular preferred embodiment of the invention, the polymerized units A (and thus monomers A) comprise units of polymerized maleic acid. In this particular preferred embodiment, the molar amount of polymerized units of maleic acid amount to at least 50 mol-%, in particular at least 70 mol-%, especially at least 80 mol-% of the total amount of units (or monomers) A. The remainder of the units (or monomers) A, if present at all, will usually be derived from the aforementioned ethylenically unsaturated monocarboxylic acids such as acrylic acid or methacrylic acid. In particular, the polymerized units A are units of polymerized maleic acid or a mixture of maleic acid with at least one ethylenically unsaturated monocarboxylic acid, which is preferably selected from acrylic acid and methacrylic acid and mixtures thereof, wherein the amount of maleic acid is at least 50 mol-%, in particular at least 70 mol-% or at least 80 mol-% of the total amount polymerized units (or monomers) A. In the mixtures, the amount of ethylenically unsaturated monocarboxylic acids is e.g. from 0.5 to 50 mol-%, in particular from 1 to 30 mol-%, especially from 2 to 20 mol-% of the total amount polymerized units (or monomers) A. Preferably, maleic acid is the only monomer A or amounts to at least 99 mol-% of the total amount polymerized units (or monomers) A.

In this particular preferred first embodiment, the monomers B are preferably selected from $C_2$-$C_{50}$-olefins, vinylaromatic compounds, $C_2$-$C_{50}$-alkylesters of $C_3$-$C_8$-monocarboxylic acids, bis-$C_1$-$C_{50}$-alkylesters of $C_4$-$C_8$-dicarboxylic acids, N—$C_2$-$C_{50}$-alkylamides of $C_3$-$C_8$-monocarboxylic acids, N—$C_1$-$C_{50}$-alkyl-N—$C_1$-$C_{50}$-alkylamides of $C_3$-$C_8$-monocarboxylic acids and vinylesters of $C_2$-$C_{50}$-alkanoic acids, vinyl-$C_1$-$C_{40}$-alkylethers, N—$C_1$-$C_{40}$-alkylimides of maleic acid and mixtures thereof. In particular, the monomers B are selected from $C_2$-$C_{50}$-olefins, vinylaromatic compounds, 02-$C_{50}$-alkylesters of $C_3$-$C_8$-monocarboxylic acids, N—$C_2$-$C_{50}$-alkylamides of $C_3$-$C_8$-monocarboxylic acids and vinylesters of $C_2$-$C_{50}$-alkanoic acids.

Amongst the polymers P of the first particular preferred embodiment, those polymers P are preferred, which comprise as monomer B at least one $C_5$-$C_{50}$-olefin, optionally in combination with at least one further monomer B, selected from $C_2$-$C_4$-olefins, vinylaromatic compounds, $C_2$-$C_{50}$-alkylesters of $C_3$-$C_8$-monocarboxylic acids, bis-$C_1$-$C_{50}$-alkylesters of $C_4$-$C_8$-dicarboxylic acids, N—$C_2$-$C_{50}$-alkylamides of $C_3$-$C_8$-monocarboxylic acids, N—$C_1$-$C_{50}$-alkyl-N—$C_1$-$C_{50}$-alkylamides of $C_3$-$C_8$-monocarboxylic acids, vinylesters of $C_1$-$C_{50}$-alkanoic acids, vinyl-$C_1$-$C_{40}$-alkylethers, N—$C_1$-$C_{40}$-alkylimides of maleic acid and mixtures thereof; more preferably at least one $C_5$-$C_{50}$-olefin, optionally in combination with at least one further monomer B, selected from $C_2$-$C_4$-olefins, vinylaromatic compounds and $C_2$-$C_{50}$-alkylesters of $C_3$-$C_8$-monocarboxylic acids. In the polymers P of this particular preferred first embodiment, where the monomers B comprise at least one $C_2$-$C_{50}$-olefin, the amount of $C_2$-$C_{50}$-olefin is preferably at least 50 mol-%, in particular at least 70 mol-% or at least 80 mol-% of the total amount polymerized units (or monomers) B. If other monomers B are present, they will generally not exceed 50 mol-%, in particular 30 mol-% or 20 mol-% of the total amount polymerized units (or monomers) B. In the mixtures, the amount of ethylenically unsaturated monomers B different from $C_2$-$C_{50}$-olefin is e.g. from 0.5 to 50 mol-%, in particular from 1 to 30 mol-%, especially from 2 to 20 mol-% of the total amount polymerized units (or monomers) B. Preferably, the one ore more $C_2$-$C_{50}$-olefins are the only monomer B or amounts to at least 99 mol-% of the total amount polymerized units (or monomers) B.

In the polymers P of the first particular preferred embodiment, the molar ratio of polymerized monomers A (i.e. maleic acid or mixtures thereof with one or more of the aforementioned ethylenically unsaturated monocarboxylic acids) to polymerized monomers B is preferably from 1:10 to 10:1, in particular from 1:5 to 5:1. In the preferred polymers P of this embodiment, the weight ratio of polymerized units A to polymerised units B, and thus the weight ratio of polymerized monomers A to polymerized monomers B is generally from 10:90 to 80:20, in particular from 15:85 to 70:30 and more preferably from 20:80 to 60:40. Preferably the total amount of polymerized units A and polymerised units B, and thus the total amount of polymerized monomers A and polymerized monomers B make up at least 80% by weight, in particular at least 90% by weight and more preferably at least 95% by weight of the polymer P of this first particular preferred embodiment.

In a second particular preferred embodiment of the invention, the polymerized units A (and thus monomers A) comprise units of polymerized monoethylenically unsaturated $C_3$-$C_8$ monocarboxylic acid, in particular units of acrylic acid or methacrylic acid, optionally in combination with minor amounts of units of polymerized monoethylenically unsaturated $C_4$-$C_8$-dicarboxylic acid. In this particular preferred embodiment, the molar amount of polymerized units of monoethylenically unsaturated $C_3$-$C_8$ monocarboxylic acid amount to at least 70 mol-%, in particular at least 90 mol-%, especially at least 99 mol-% of the total amount of polymerized units (or monomers) A. Consequently the amount of units of polymerized monoethylenically unsaturated $C_4$-$C_8$-dicarboxylic acid will not exceed 30 mol-%, in particular 10 mol-%, especially 1 mol-% of the total amount of polymerized units (or monomers) A.

In this second particular preferred embodiment, the monomers B are preferably selected from $C_2$-$C_{50}$-olefins, vinylaromatic compounds, $C_2$-$C_{50}$-alkylesters of $C_3$-$C_8$-monocarboxylic acids, bis-$C_1$-$C_{50}$-alkylesters of $C_4$-$C_8$-dicarboxylic acids, N—$C_2$-$C_{50}$-alkylamides of $C_3$-$C_8$-monocarboxylic acids, N—$C_1$-$C_{50}$-alkyl-N—$C_1$-$C_{50}$-alkylamides of $C_3$-$C_8$-monocarboxylic acids, vinylesters of $C_2$-$C_{50}$-alkanoic acids, vinyl-$C_1$-$C_{40}$-alkylethers, N—$C_1$-$C_{40}$-alkylimides of maleic acid and mixtures thereof. In particular, the monomers B are selected from $C_2$-$C_{50}$-olefins, vinylaromatic compounds, $C_2$-$C_{50}$-alkylesters of $C_3$-$C_8$-monocarboxylic acids, N—$C_2$-$C_{50}$-alkylamides of $C_3$-$C_8$-monocarboxylic acids and vinylesters of $C_2$-$C_{50}$-alkanoic acids.

Amongst the polymers P of the second particular preferred embodiment, those polymers P are preferred, which comprise as monomer B at least one $C_2$-$C_{50}$-alkylester of a $C_3$-$C_8$-monocarboxylic acid, in particular at least one $C_2$-$C_{50}$-alkylester of acrylic acid or methacrylic acid, optionally in combination with at least one further monomer B, selected from $C_2$-$C_4$-olefins, vinylaromatic compounds, $C_2$-$C_{50}$-alkylesters of $C_3$-$C_8$-monocarboxylic acids, bis-$C_1$-$C_{50}$-alkylesters of $C_4$-$C_8$-dicarboxylic acids, N—$C_2$-$C_{50}$-alkylamides of $C_3$-$C_8$-monocarboxylic acids, N—$C_1$-$C_{50}$-alkyl-N—$C_1$-$C_{50}$-alkylamides of $C_3$-$C_8$-monocarboxylic acids, vinylesters of $C_2$-$C_{50}$-alkanoic acids, vinyl-$C_1$-$C_{40}$-alkylethers, N—$C_1$-$C_{40}$-alkylimides of maleic acid and mixtures thereof, more preferably at least one $C_2$-$C_{20}$-alkylester of a $C_3$-$C_8$-monocarboxylic acid, in particular at least one $C_2$-$C_{20}$-alkylester of acrylic acid or methacrylic acid, optionally in combination with at least one further monomer B, selected from N—$C_2$-$C_{50}$-alkylamides of $C_3$-$C_8$-monocarboxylic acids, N—$C_1$-$C_{50}$-alkyl-N—$C_1$-$C_{50}$-alkylamides of $C_3$-$C_8$-monocarboxylic acids and vinylesters of $C_2$-$C_{50}$-alkanoic acids. In the polymers P of this particular preferred second embodiment, where the monomers B comprise at least one $C_2$-$C_{50}$-alkylester of a $C_3$-$C_8$-monocarboxylic acid, the amount of $C_2$-$C_{50}$-alkylester of a $C_3$-$C_8$-monocarboxylic acid is preferably at least 50 mol-%, in particular at least 70 mol-% or at least 80 mol-% of the total amount polymerized units (or monomers) B. If other monomers B are present, they will generally not exceed 50 mol-%, in particular 30 mol-% or 20 mol-% of the total amount polymerized units (or monomers) B. In the mixtures, the amount of ethylenically unsaturated monomers B different from $C_2$-$C_{50}$-alkylester of a $C_3$-$C_8$-monocarboxylic acid is e.g. from 0.5 to 50 mol-%, in particular from 1 to 30 mol-%, especially from 2 to 20 mol-% of the total amount polymerized units (or monomers) B. Preferably, the one ore more $C_2$-$C_{50}$-alkylesters of a $C_3$-$C_8$-monocarboxylic acid are the only monomer B or amounts to at least 99 mol-% of the total amount polymerized units (or monomers) B.

Amongst the polymers P of the second particular preferred embodiment, those polymers P are likewise preferred, which comprise as monomer B at least one $C_2$-$C_4$-olefin, optionally in combination with at least one further monomer B, selected from $C_2$-$C_{50}$-alkylesters of $C_3$-$C_8$-monocarboxylic acids, bis-$C_1$-$C_{50}$-alkylesters of $C_4$-$C_8$-dicarboxylic acids, N—$C_2$-$C_{50}$-alkylamides of $C_3$-$C_8$-monocarboxylic acids, N—$C_1$-$C_{50}$-alkyl-N—$C_1$-$C_{50}$-alkylamides of $C_3$-$C_8$-monocarboxylic acids, vinylesters of $C_1$-$C_{50}$-alkanoic acids, vinyl-$C_1$-$C_{40}$-alkylethers, N—$C_1$-$C_{40}$-alkylimides of maleic acid and mixtures thereof; more preferably at least one $C_2$-$C_4$-olefin, optionally in combination with at least one further monomer B, selected from $C_2$-$C_{50}$-alkylesters of $C_3$-$C_8$-monocarboxylic acids. In the polymers P of this particular preferred second embodiment, where the monomers B comprise at least one $C_2$-$C_4$-olefin, the amount of $C_2$-$C_4$-olefin is preferably at least 50 mol-%, in particular at least 70 mol-% or at least 80 mol-% of the total amount polymerized units (or monomers) B. If other monomers B are present, they will generally not exceed 50 mol-%, in particular 30 mol-% or 20 mol-% of the total amount polymerized units (or monomers) B. In the mixtures, the amount of ethylenically unsaturated monomers B different from $C_2$-$C_4$-olefin is e.g. from 0.5 to 50 mol-%, in particular from 1 to 30 mol-%, especially from 2 to 20 mol-% of the total amount polymerized units (or monomers) B. Preferably, the one ore more $C_2$-$C_4$-olefins are the only monomer B or amounts to at least 99 mol-% of the total amount polymerized units (or monomers) B.

Amongst the polymers P of the second particular preferred embodiment, those polymers P are likewise preferred, which comprise as monomer B at least one vinylaromatic compound such as styrene and/or α-methylstyrene, optionally in combination with at least one further monomer B, selected from $C_2$-$C_{50}$-olefins, vinylaromatic compounds, $C_2$-$C_{50}$-alkylesters of $C_3$-$C_8$-monocarboxylic acids, bis-$C_1$-$C_{50}$-alkylesters of $C_4$-$C_8$-dicarboxylic acids, N—$C_2$-$C_{50}$-alkylamides of $C_3$-$C_8$-monocarboxylic acids, N—$C_1$-$C_{50}$-alkyl-N—$C_1$-$C_{50}$-alkylamides of $C_3$-$C_8$-monocarboxylic acids, vinylesters of $C_2$-$C_{50}$-alkanoic acids, vinyl-$C_1$-$C_{40}$-alkylethers, N—$C_1$-$C_{40}$-alkylimides of maleic acid and mixtures thereof. In the polymers P of this particular preferred first embodiment, where the monomers B comprise at least one vinylaromatic compound, the amount of vinylaromatic compound is preferably at least 50 mol-%, in particular at least 70 mol-% or at least 80 mol-% of the total amount polymerized units (or monomers) B. If other monomers B are present, they will generally not exceed 50 mol-%, in particular 30 mol-% or 20 mol-% of the total amount polymerized units (or monomers) B. In the mixtures, the amount of ethylenically unsaturated monomers B different from vinylaromatic compounds is e.g. from 0.5 to 50 mol-%, in particular from 1 to 30 mol-%, especially from 2 to 20 mol-% of the total amount polymerized units (or monomers) B. Preferably, the one ore more vinylaromatic compounds are the only monomer B or amounts to at least 99 mol-% of the total amount polymerized units (or monomers) B.

In the polymers P of the second particular preferred embodiment, the molar ratio of polymerized monomers A to polymerized monomers B is preferably from 1:20 to 5:1, in particular from 1:10 to 3:1. In the preferred polymers P of this embodiment, the weight ratio of polymerized units A to polymerised units B, and thus the weight ratio of polymerized monomers A to polymerized monomers B is generally from 2:98 to 50:50, in particular from 3:97 to 50:50 and more preferably from 5:95 to 50:50. Preferably the total amount of polymerized units A and polymerised units B, and thus the total amount of polymerized monomers A and polymerized monomers B make up at least 90% by weight, in particular at least 95% by weight and more preferably at least 99% by weight of the polymer P of this second particular preferred embodiment.

Apart from the carboxyl groups and hydrophobic repeating units the polymers P of the invention may contain poly-$C_2$-$C_4$-alkylene oxide groups, especially polyethylenoxide groups, where the poly-$C_2$-$C_4$-alkylene oxide groups preferably have a molecular weight (number average) in the range from 100 to 5000. The amount of poly-$C_2$-$C_4$-alkylene oxide groups will generally not exceed 30%, in particular less than 10% by weight of the polymer P. In a particular preferred embodiment of the invention, the polymer P does not contain poly-$C_2$-$C_4$-alkylene oxide groups.

The number-average molecular weight $M_n$ of the polymers P may be in the range from 300 to 500000, in particular from 500 to 100000, in particular from 700 to 50000 and especially from 1000 to 30000.The weight-average molecular weight $M_w$ is preferably in the range from about 500 to 1000000, more preferably from 1000 to 200000, in particular from 1500 to 100000 and especially from 2000 to 50000. The K value (in accordance with Fikentscher—Cellulosechemie 1932, Vol. 13, pp. 58-64 and pp. 71-74) of the polymers P is typically in the range from 5 to 120, in particular from 10 to 100 and in especially in the range from 15 to 80 (determined as a solution in water or tetrahydrofurane at 20° C. at a concentration, dependent on the K value, in the range from 0.1 to 5% by weight).

The polymers can be prepared by homo- or copolymerizing suitable monoethylenically monomers which, upon polymerization, form the polymer P. In the polymerization, the ethylenically double bond is polymerized to form the C—C-backbone.

For example, the polymers P can be produced by copolymerizing ethylenically unsaturated monomers A with hydrophobic monomers B, which are likewise ethylenically unsaturated monomers. If the monomers B carry a carboxyl group, it is also possible to prepare the polymer P by homopolymerizing these monomers B carrying a carboxyl group or by copolymerizing said monomers B with further monomers A and/or B. If the polymer P contains units of maleic acid, it is possible to use maleic anhydride instead of maleic acid in the polymerization reaction and then to hydrolyse the polymer obtained from the polymerization reaction. If the polymer P contains units of maleic imides, it is possible to use maleic anhydride instead of the respective maleic imide in the polymerization reaction and then to react the polymer obtained from the polymerization reaction with a suitable amine, thereby forming the maleimide moieties. Likewise, if the polymer P contains units of units of monoamides or monoesters of dicarboxylic acids, such as monoamides or monoesters of maleic acid it is possible to use the corresponding anhydride, such as maleic anhydride, instead of the respective monoamide in the polymerization reaction and then to react the polymer obtained from the polymerization reaction with a suitable amine or alcohol, thereby forming the monoamide or monoester moieties. The monomers A may be polymerized in their acidic form or in the form of their salts, in particular their alkalimetal salts. Preferably, the monomers A are used in the acidic form or, in case of maleic acid, in the form of the anhydride.

Suitable methods for preparing the polymers P include mass polymerization of the monomers A and B, solution polymerization, suspension polymerization and emulsion polymerization, with preference given to solution polymerization and mass polymerization.

The polymerization of the monomers forming the polymer P is usually initiated in the presence of a initiator, which decays by forming radicals. The polymerization initiator are generally used in amounts of from 0.05 to 10% by weight, in particular 0.1 to 5% by weight, based on the monomers forming the polymer P. Suitable initiators are, for example, organic peroxides and hydroperoxides, also peroxodisulfates, percarbonates, peroxide esters, hydrogen peroxide and azo compounds. Examples of initiators are hydrogen peroxide, dicyclohexyl peroxydicarbonate, diacetyl peroxide, di-tert-butyl peroxide, diamyl peroxide, dioctanoyl peroxide, didecanoyl peroxide, dilauroyl peroxide, dibenzoyl peroxide, bis(o-tolyl)peroxide, succinyl peroxide, methyl ethyl ketone peroxide, di-tert-butyl hydroperoxide, acetylacetone peroxide, butyl peracetate, tert-butyl permaleinate, tert-butyl perisobutyrate, tert-butyl perpivalate, tert-butyl peroctoate, tert-butyl perneodecanoate, tert-butyl perbenzoate, tert-butyl hydroperoxide, cumene hydroperoxide, tert-butyl perneodecanoate, tert-amyl perpivalate, tert-butyl perpivalate, tert-butyl perbenzoate, tert-butyl peroxy-2-ethylhexanoate and diisopropyl peroxydicarbamate; also lithium, sodium, potassium and ammonium peroxodisulfate, 2,2'-azobisisobutyronitrile, 2,2'-azobis(2-methyl-butyronitrile), 2,2'-azobis[2-methyl-N-(2-hydroxyethyl)]propionamide, 1,1'-azobis(1-cyclohexanecarbonitrile), 2,2'-azobis(2,4-dimethylvaleronitrile), 2,2'-azobis (N,N'-dimethyleneisobutyroamidine)dihydrochloride, and 2,2'-azobis(2-amidinopropane) dihydrochloride, and redox initiator systems explained below. Redox initiator systems comprise at least one oxidizing, generally a peroxide compound and at least one reducing compound, for example a reducing sulfur compound, such as bisulfites, sulfites, thiosulfates, dithionites, tetrathionates of alkali metals or ammonium salts thereof or an organic reducing agent, such as benzoine, dimethylaniline, ascorbic acid, hydroxymethanesulfinates, and adducts of hydrogensulfite onto ketones, such as, for example, the acetone-bisulfite adduct. In combination with the initiators or the redox initiator systems it is additionally possible to use transition metal catalysts, e.g. salts of iron, cobalt, nickel, copper, vanadium and manganese. Suitable salts are, for example, iron(II)sulfate, cobalt(II)chloride, nickel(II)sulfate, or copper(I)chloride. Based on the monomers, the reducing transition metal salt is used in a concentration of from 0.1 ppm to 1000 ppm. It is thus possible to use combinations of hydrogen peroxide with iron(II) salts, such as, for example, 0.5 to 30% hydrogen peroxide and 0.1 to 500 ppm of Mohr's salt.

If appropriate, it may be required to control the molecular weight of the polymers to be produced. For this purpose, the polymerization of the monomers M is generally carried out in the presence of regulators. The regulators include, for example, organic compounds containing SH groups, alkylmercaptans having preferably from 6 to 20 carbon atoms such as hexylmercaptan, octylmercaptan, 2-ethylhexylmercaptan, n-decylmercaptan, isodecylmercaptan, n-dodecylmercaptan, tert.-dodecylmercaptan, polar mercaptans such as 2-mercaptoethanol, 2-mercaptopropanol, mercaptobutanol, thioglycolic acid (2-mercaptoacetic acid) 3-mercaptopropionic acid, cysteine and N-acetylcysteine, and also formic acid, isopropanol, allylalcohol, aldehydes such as butanal, halogen hydrocarbons such as trichloromethane tribromomethane and tetrachloromethane, and the like. The polymerization regulators are, if desired, generally used in amounts of from 0.05 to 2% by weight, in particular 0.1 to 1% by weight, based on the monomers forming the polymer P.

The required reaction temperature and reaction pressure depends on the type of polymer and the type of monomers to be polymerized in a known manner. Generally the polymerization temperatures will be in the range from 10 to 250° C., in particular from 30 to 180° C. The reaction pressure will usually be in the range from 0.1 bar to 2500 bar, in particular from 0.9 bar to 2000 bar.

If the polymer P contains poly-$C_2$-$C_4$-alkylene oxide groups, especially polyethylenoxide groups, these groups can be introduced by choice of suitable monomers C having a poly-$C_2$-$C_4$-alkylene oxide group, or by grafting compounds having poly-$C_2$-$C_4$-alkylene oxide units onto a preformed polymer P, e.g. by an esterification or amidation reaction, or by polymerization of the ethylenically unsaturated monomers forming the C—C-backbone in the presence of non-polymerizable compounds having a poly-$C_2$-$C_4$-alkylene oxide group.

The polymers P used in the invention and suitable processes for preparing them are known in the art, e.g. from EP 412389, DE 3730885, DE 10251141, DE 19810404, EP 498634, DE 3926168, DE 3931039, DE 4402029, WO 93/17130, PCT/EP 2007/062189, U.S. Pat. Nos. 4,414,370, 4,529,787, 4,546,160,6,858,678, 6,355,727 and Ullmann's Encyclopedia of Industrial Chemistry, 5. ed., Waxes, Vol. A 28, pp. 146 ff., Verlag Chemie Weinheim, Basel, Cambridge, N.Y., Tokio, 1986. Some of the polymers are commercially available, e.g. as Sokalan® types and Joncryl® types of BASF SE.

The composition of the invention are in the form of particles preferably comprise the at least one enzyme and the at least one polymer P in a weight ratio of enzyme to polymer P from 1:50 to 10:1, in particular from 1:40 to 5:1, more preferably from 1:30 to 2:1, especially from 1:20 to 1:2 or from 1:20 to 1:5. Generally the total amount of the at least one enzyme and the at least one polymer P is at last 30% by weight, preferably at least 40% by weight, in particular at least 50% by weight, more preferably at least 70% by weight, especially at lest 80% by weight or at least 90% by weight, based on the weight of the enzyme containing particles.

The composition of the invention may additionally contain further components which are generally useful in particulate enzyme compositions. These further components are herein also termed as formulation additives. The amount of these further components will generally not exceed 70% by weight, preferably not exceed 60% by weight, in particular not exceed 50% by weight, more preferably not exceed 30% by weight, especially not exceed 20% by weight or 10% by weight.

Additional components, which can be incorporated into the particles include e.g. polysaccharides, waxes, enzyme activators or enhancing agents, fillers, enzyme stabilizing agents, solubilising agents, crosslinking agents, suspension agents, viscosity regulating agents, light spheres, chlorine scavengers, plasticizers, pigments, salts, preservatives and fragrances.

Suitable polysaccharides may be un-modified naturally occurring polysaccharides or modified naturally occurring polysaccharides. Suitable polysaccharides include cellulose, pectin, dextrin and starch. The starches may be soluble or insoluble in water. In a particular embodiment of the present invention the polysaccharide is a starch. In a particular embodiment of the present invention the polysaccharide is an insoluble starch. Naturally occurring starches from a wide variety of plant sources are suitable (either as starches per se, or as the starting point for modified starches), and relevant starches include starch e.g. from: rice, corn, wheat, potato, oat, cassava, sago-palm, yuca, barley, sweet potato, sorghum, yams, rye, millet, buckwheat, arrowroot, taro, tannia, and may for example be in the form of flour. Cassava starch is among preferred starches in the context of the invention; in this connection it may be mentioned that cassava and cassava starch are known under various synonyms, including tapioca, manioc, mandioca and manihot. As employed in the context of the present invention, the term "modified starch" denotes a naturally occurring starch, which has undergone some kind of at least partial chemical modification, enzymatic modification, and/or physical or physicochemical modification, and which—in general—exhibits altered properties relative to the "parent" starch.

A "wax" in the context of the present invention is to be understood as a polymeric material having a melting point between 25-150° C., particularly 30 to 100° C. more particularly 35 to 85° C. most particularly 40 to 75° C. The wax is preferably in a solid state at room temperature, 25° C. The lower limit is preferred to set a reasonable distance between the temperature at which the wax starts to melt to the temperature at which the particles or compositions comprising the particles are usually stored, 20 to 30° C. For some particles, e.g. particles used in the detergent industry, a preferable feature of the wax is that the wax should be water soluble or water dispersible, particularly in neutral and alkaline solution, so that when the coated particles of the invention is introduced into an aqueous solution, i.e. by diluting it with water, the wax should disintegrate and/or dissolve providing a quick release and dissolution of the active incorporated in the particles to the aqueous solution. Examples of water soluble waxes are poly ethylene glycols (PEG's). Amongst water insoluble waxes, which are dispersible in an aqueous solution are triglycerides and oils. For some particles it is preferable that the coating contains some insoluble waxes e.g. feed particles.

The wax may be any wax, which is chemically synthesized or a wax isolated from a natural source or a derivative thereof. Accordingly, suitable waxes are selected from the following non limiting list of waxes.

- Polyethylene glycols, PEG. Different PEG waxes are commercially available having different molecular sizes, wherein PEG's with low molecular sizes also have low melting points. Examples of suitable PEG's are PEG 1500, PEG 2000, PEG 3000, PEG 4000, PEG 6000, PEG 8000, PEG 9000 etc. e.g. from BASF (Pluriol E series) or from Clariant or from Ineos. Derivatives of Poly ethylene glycols may also be used.
- polypropylene glycols (e.g. polypropylene glycol Pluriol P series from BASF) and polyethyleneglycol-polypropyleneglycol blockcopolymers. Derivatives of polypropyleneglycols or polyethyleneglycol-polypropyleneglycol blockcopolymers may also be used.
- Nonionic surfactants which are solid at room temperature such as ethoxylated fatty alcohols having a high level of ethoxy groups such as the Lutensol AT series from BASF, a $C_{16}$-$C_{18}$ fatty alcohol having different amounts of ethyleneoxide per molecule, e.g. Lutensol AT11, AT13, AT25, AT50, AT80, where the number indicate the average number of ethyleneoxide groups. Alternatively polymers of ethyleneoxide, propyleneoxide or copolymers thereof are useful, such as in block polymers, e.g. Pluronic PE 6800 from BASF. Derivatives of ethoxylated fatty alcohols are preferred.
- Waxes isolated from a natural source, such as Carnauba wax (melting point between 80-88° C.), Candelilla wax (melting point between 68-70° C.) and bees wax. Other natural waxes or derivatives thereof are waxes derived from animals or plants, e.g. of marine origin. Hydrogenated plant oil or animal tallow are likewise suitable. Examples of such waxes are hydrogenated ox tallow, hydrogenated palm oil, hydrogenated cotton seeds and/or hydrogenated soy bean oil, wherein the term "hydrogenated" as used herein is to be construed as saturation of unsaturated carbohydrate chains, e.g. in triglycerides, wherein carbon=carbon double bonds are converted to carbon-carbon single bonds. Hydrogenated palm oil is commercially available e.g. from Hobum Oele and Fette GmbH—Germany or Deutsche Cargill GmbH—Germany.
- Fatty acid alcohols, such as the linear long chain fatty acid alcohol NAFOL 1822 ($C_{18, 20, 22}$) from Condea Chemie GMBH—Germany, having a melting point between 55-60° C. Derivatives of fatty acid alcohols are likewise useful.
- Monoglycerides and/or di-glycerides, such as glyceryl stearate, wherein stearate is a mixture of stearic and palmitic acid, are useful waxes. An example of this is Dimodan PM—from Danisco Ingredients, Denmark.
- Fatty acids, such as hydrogenated linear long chained fatty acids and derivatives of fatty acids.
- Paraffines, i.e. solid hydrocarbons.
- Micro-crystalline wax.

Further suitable waxes can be found in C. M. McTaggart et. al., Int. J. Pharm. 19, 139 (1984) or Flanders et. al., Drug Dev. Ind. Pharm. 13, 1001 (1987) both incorporated herein by reference.

In a particular embodiment of the present invention the wax of the present invention is a mixture of two or more different waxes. In a particular embodiment of the present invention the wax or waxes is selected from the group consisting of PEG, ethoxylated fatty alcohols, fatty acids, fatty acid alcohols and glycerides. In another particular embodiment of the present invention the waxes are chosen from synthetic waxes. In a more particular embodiment the waxes of the present invention are PEG or nonionic surfactants. In a most particular embodiment of the present invention the wax is PEG.

Suitable fillers are water soluble and/or insoluble inorganic salts such as finely ground alkali sulphate, alkali carbonate and/or alkali chloride, clays such as kaolin (e.g. SPESWHITE®, English China Clay), bentonites, talcs, zeolites, chalk, calcium carbonate and/or silicates. Typical fillers are di-sodium sulphate and calcium-lignosulphonate. Other fillers are silica, gypsum, kaolin, talc, magnesium aluminium silicate and cellulose fibres.

Suitable enzyme stabilizing or -protective agents may fall into several categories and include, e.g. alkaline or neutral materials, reducing agents, antioxidants and/or salts of first transition series metal ions. Each of these may be used in conjunction with other protective agents of the same or different categories. Examples of alkaline protective agents are alkali metal silicates, -carbonates or bicarbonates which provide a chemical scavenging effect by actively neutralizing e.g. oxidants. Examples of reducing protective agents are salts of sulfite, thiosulfite or thiosulfate, while examples of antioxidants are methionine, butylated hydroxytoluene (BHT) or butylated hydroxyanisol (BHA). Most preferred agents are salts of thiosulfates, e.g. sodium thiosulfate. Also enzyme stabilizers may be borates, borax, formates, di- and tricarboxylic acids and so called reversible enzyme inhibitors such as organic compounds with sulfhydryl groups or alkylated or arylated boric acids.

Suitable cross-linking agents include e.g. enzyme-compatible surfactants, e.g. ethoxylated alcohols, especially ones with 10 to 80 ethoxy groups.

The solubility of the particle may be critical in cases where the coated particle is a component of a detergent formulation. As is known by the person skilled in the art, many agents, through a variety of methods, serve to increase the solubility of formulations, and typical agents known to the art can be found in National Pharmacopeia's.

Light spheres are small particles with low true density. Typically, they are hollow spherical particles with air or gas inside. Such materials are usually prepared by expanding a solid material. These light spheres may be inorganic of nature or organic of nature, such as the PM-series (plastic hollow spheres) available from The PQ Corporation. Light spheres can also be prepared from polysaccharides, such as starch or derivatives thereof. Biodac® is an example of non-hollow lightweight material made from cellulose (waste from paper-making), available from GranTek Inc. These materials may be included in the particles of the invention either alone or as a mixture of different light materials.

Suspension agents, mediators (for boosting bleach action upon dissolution of the particle in e.g. a washing application) and/or solvents may be incorporated in the particle.

Plasticizers useful in particles in the context of the present invention include, for example: polyols such as sugars, sugar alcohols, glycerine, glycerol trimethylol propane, neopentyl glycol, triethanolamine, mono-, di- and triethylene glycol or polyethylene glycols (PEGs) having a molecular weight less than 1000; urea, phthalate esters such as dibutyl or dimethyl phthalate; thiocyanates, non-ionic surfactants such as ethoxylated alcohols and ethoxylated phosphates and water.

Suitable pigments include, but are not limited to, finely divided whiteners, such as titanium dioxide or kaolin, coloured pigments, water soluble colorants, as well as combinations of one or more pigments and water soluble colorants.

Suitable salts which can be incorporated in the particles may be any inorganic salt, e.g. salts of sulfate, sulfite, phosphate, phosphonate, nitrate, chloride or carbonate or salts, or salts of simple organic acids, in particular mono-, di- or tricarboxylic acids which preferably have less than 10 carbon atoms e.g. 6 or less carbon atoms such as citrate, malonate, gluconate, lactate, malate, maleate, succinate, formiate, propionate, butyrate or acetate. Examples of cations in these salt are alkali or earth alkali metal ions, although the ammonium ion or metal ions of the first transition series, such as sodium, potassium, magnesium, calcium, zinc or aluminium. Examples of anions include chloride, bromide, iodide, sulfate, sulfite, bisulfite, thiosulfate, phosphate, monobasic phosphate, dibasic phosphate, hypophosphite, dihydrogen pyrophosphate, tetraborate, borate, carbonate, bicarbonate, metasilicate, citrate, malate, maleate, malonate, succinate, lactate, formate, acetate, butyrate, propionate, benzoate, tartrate, ascorbate or gluconate. In particular alkali- or earth alkali metal salts of sulfate, sulfite, phosphate, phosphonate, nitrate, chloride or carbonate or salts of simple organic acids such as citrate, malonate or acetate may be used. Specific examples include $NaH_2PO_4$, $Na_2HPO_4$, $Na_3PO_4$, $(NH_4)H_2PO_4$, $K_2HPO_4$, $KH_2PO_4$, $Na_2SO_4$, $K_2SO_4$, $KHSO_4$, $ZnSO_4$, $MgSO_4$, $CuSO_4$, $Mg(NO_3)_2$, $(NH_4)_2SO_4$, sodium borate, magnesium acetate, magnesium formiate, magnesium propionate, magnesium lactate, magnesium gluconate, magnesium citrate, calcium acetate, calcium formiate, calcium propionate, calcium lactate, calcium gluconate, calcium citrate, zinc acetate, zinc formiate, zinc propionate, zinc lactate, zinc gluconate, zinc citrate and sodium citrate. The salt may also be a hydrated salt, i.e. a crystalline salt hydrate with bound water(s) of crystallization, such as described in WO 99/32595. Examples of hydrated salts include magnesium sulfate heptahydrate ($MgSO_4(7H_2O)$), zinc sulfate heptahydrate ($ZnSO_4(7H_2O)$), copper sulfate pentahydrate ($CuSO_4(5H_2O)$), sodium phosphate dibasic heptahydrate ($Na_2HPO_4(7H_2O)$), magnesium nitrate hexahydrate ($Mg(NO_3)_2(6H_2O)$), sodium borate decahydrate, sodium citrate dihydrate and magnesium acetate tetrahydrate.

In a preferred embodiment of the invention the enzyme containing particles comprise at least one salt of at least one bivalent metal cation selected from $Zn^{2+}$, $Mg^{2+}$, $Ca^{2+}$ and mixtures thereof. Suitable salts include salts of the aforementioned anions, in particular salts of sulphuric acid (sulfates), of phosphoric acid (phosphates, mono- and dihydrogenphosphates and ammoniumhydrogenphosphates), chlorides or salts of simple organic acids, in particular mono-, di- or tricarboxylic acids which preferably have less than 10 carbon atoms e.g. 6 or less carbon atoms such as citrate, malonate, gluconate, lactate, malate, maleate, succinate, formiate, propionate, butyrate or acetate, with preference given to salts of simple organic acids. Particular preference is given to calcium salts, especially those of simple organic acids. The amount of theses salts will generally be chosen, that the enzyme containing particles contain from 0.1 to 10% by weight, in particular from 0.5 to 8% by weight, especially from 1 to 5% by weight, based on the total weight of the enzyme of the at least one bivalent ion.

In the particles of the invention, the polymer and the enzyme and the optional further components will usually present as an intimate mixture, i.e. the distribution of the ingredients within the particles is homogenous or virtually homogenous. However, the particles may also have a core shell structure. The term "core shell structure" means that the distribution of the components within the particles is not homogenous. Rather, at least one component of the particles is predominantly located in the inner region of the particle while at least one other component is predominantly located in the outer region of the particle. In these core shell particles, the enzyme is preferably located in the inner region of the particle. In a particular preferred embodiment of the invention, the distribution of the components within the particles is homogenous or virtually homogenous.

The particle size of the particles in the composition of the invention may vary. Preferably the volume average particle diameter of the enzyme containing particles is from 50 nm to 90 μm, in particular from 100 nm to 80 μm, more preferably from 200 nm to 50 μm, especially from 1 to 20 μm, particularly preferable from 0.5 to 20 μm. However, the volume average particle diameter may be as small as from 50 to 500 nm. Generally, at least 90% by weight of the particles have a particle diameter of at most 150 μm, preferably at most 100 μm, more preferably at most 70 μm, in particular at most 50 μm and especially at most 30 μm. The particle size may be determined by conventional techniques such as light scattering as described e.g. in D. Distler, Wässrige Polymerdispersionen [Aqueos Polymer Dispersions], Wiley-VCH 1999, chapter 4.2.1, p. 40ff, H. Auweter, D. Horn, J. Colloid Interf. Sci. 105 (1985) 399, D. Lilge, D. Horn, Colloid Polym. Sci. 269 (1991) 704 or H. Wiese, D. Horn, J. Chem. Phys. 94 (1991) 6429 or W. Brown, Dynamic Light Scattering Oxford University Press, 1992.

The particles of the present invention may comprise one, two or more additional coating layers. In a particular embodiment of the present invention the particle comprise at least two coating layers.

Additional coatings may be applied to the particle to provide additional characteristics or properties. Thus, for example, an additional coating may achieve one or more of the following effects:

(i) further protection of the active compound in the particle against hostile compounds in the surroundings.

(ii) dissolution at a desired rate upon introduction of the particle into a liquid medium (such as an acid medium);

(iii) provide a better physical strength of the particle.

In a particular embodiment of the present invention an outer layer may be applied as known within microencapsulation technology, e.g. via polycondensation as interfacial polymerization and in situ polymerization, coacervation, gelation and chelation, solvent extraction, evaporation and suspension crosslinking. Different coating techniques are described in "Microspheres, Microcapsules and Liposomes", ed. Reza Arshady, Citus Books Ltd. And in WO 97/24179 which is hereby incoporated by reference.

Generally, the enzyme particles may be in the form of a powder or in the form of a dispersion in a liquid medium. Frequently, a powder is prepared in the first step, which is in a second step incorporated into a liquid medium, e.g. a polar liquid medium such as an aqueous liquid or a liquid emulsifier, liquid mixtures of emulsifiers or mixtures thereof, or non-polar liquid medium such as a liquid hydrocarbon or a liquid plant oil or mixtures thereof. In a particular preferred embodiment, the liquid medium is a liquid surfactant or a liquid mixture of surfactants (liquid emulsifiers) or contains at least 80% by weight, based on the weight of the liquid medium of at least one liquid surfactant or surfactant mixture. Examples of liquid surfactants are non-ionic surfactants like alcohol alkoxylates, in particular. Such dispersions can also contain various additives, e.g. to stabilize against sedimentation. The type of liquid medium is of minor importance and mainly depends of the intended purpose for the enzyme particles. It is, however, also possible to use processes, where the enzyme containing particles are obtained as a liquid dispersion.

The preparation of the compositions according to the invention can be accomplished by customary methods for the preparation of particulate substances whose particles comprise a plurality of components. As a rule, the components of the active substance-containing particles are mixed with one another and then processed by customary methods to give the enzyme particles. Such a process is also subject matter of the present application.

Examples of processes which are suitable in accordance with the invention are drying methods such as spray drying, freeze drying, fluidized-bed drying, fluidized-bed coating, preparation of Pickering dispersions with subsequent spray drying, and processes which include steps of particle size reduction of larger particles size such as micronization, dry or wet milling.

Preferably, the process for preparing the enzyme particles is a spray drying or emulsion drying with spray drying being more preferred. A spray drying process generally comprises the steps of preparing a solution of the enzyme and the polymer P, atomizing this solution in a gas or a liquid to make small droplets (atomizing in a gas correspond to a spray drying process, atomizing in a water immiscible liquid gives an emulsion) and drying these droplets to form solid particles. Suitable drying methods include spray drying and emulsion processes.

a) Spray drying process, wherein a liquid enzyme- and polymer-containing solution is atomized in a spray drying tower to form small droplets which during their way down the drying tower dry to form an enzyme+polymer-containing particulate material. Very small particles can be produced this way (Michael S. Showell (editor); *Powdered detergents;* Surfactant Science Series; 1998; vol. 71; page 140-142; Marcel Dekker).

b) Emulsion process, wherein an aqueous liquid enzyme- and polymer-containing solution is emulsified in a water immiscible liquid e.g. paraffinic oil. To ease the formation of droplets and stabilize the emulsion various emulsifiers and surfactants are used. The water from the droplet can subsequently be removed be distillation, e.g. azeotropic distillation, or by preferably spray drying the emulsion if the water immiscible liquid is volatile. For emulsions the drying process can be azeotropic distillation as described e.g. in EP 0356239.

Likewise preferred is a freeze drying process of a liquid enzyme and polymer containing solution.

The particles of the invention may also be prepared by a size reduction process, wherein preformed larger particles/briquettes or the like are reduced in particle size via milling the larger particles. This can be performed on dry particles (dry milling) or using a dispersion of the particles in a liquid, a so-called slurry (wet milling).

In accordance with a preferred embodiment of the invention, the preparation of the composition according to the invention is accomplished by a spray-drying method, i.e. by spray drying a liquid composition containing the at least one enzyme and the at least one polymer P. In accordance with a particular preferred embodiment of the invention, the preparation of the composition according to the invention is accomplished by spray drying an aqueous composition containing the at least one enzyme and the at least one polymer P.

To this end, in a first step, the components of the enyzme-containing particles will be mixed with one another, or dissolved, in a suitable solvent or diluent. The resulting suspension or solution will subsequently be subjected to a spray-drying method. Here, the solvent or diluent is removed with the aid of a stream of warm gas, where the components of the active substance particles which are present in the solution or suspension form a finely divided powder which can be obtained in a manner known per se. As an alternative, the components of the particles can be dissolved or dispersed separately and the resulting solutions or dispersions can be subjected to concomitant spray-drying.

In the preparation of the composition according to the invention by a spray-drying method, the components of the particles will, in a first step, be dissolved or suspended in a suitable solvent or diluent. Preferred solvents are those in which all components of the active substance-containing particles dissolve and which do not destroy the enzyme employed.

Examples of suitable solvents are:

water, $C_1$-$C_4$-alkanols such as methanol, ethanol, propanol, isopropanol, n-butanol, 2-butanol, isobutanol;

esters of $C_1$-$C_4$-aliphatic acids with $C_1$-$C_4$-alkanols such as ethyl acetate, butyl acetate, methyl butyrate;

aliphatic and alicyclic ethers with preferably 4 to 10 C atoms such as tetrahydrofuran, dioxane, diethyl ether, diisopropyl ether, methyl tert-butyl ether;

halohydrocarbons such as dichloromethane, trichloromethane, dichloroethane;

cyclic or open-chain carbonates such as ethylene carbonate, propylene carbonate, diethyl carbonate;

and mixtures of the abovementioned solvents and mixtures of the abovementioned solvents with water.

Preferably an aqueous composition containing the at least one enzyme and the at least one polymer P is subjected to the spray drying. Thus, the solvent is preferably selected from water or a mixture of water and an organic solvent which is miscible with water. Preferably the amount of water in the solvent is at least 50 vol.-%. More preferably water is the only solvent or diluent. Preferably the water or the mixture of water and organic solvent has a pH in the range from pH 6 to pH 9.

In a second step, the solvent is subsequently removed in a suitable spray apparatus with the aid of a stream of warm gas. To this end, the solution(s) or dispersion(s) is/are sprayed into a stream of warm air in a suitable apparatus. Spraying in the solution(s) or dispersion(s) can be effected in cocurrent or in countercurrent with the stream of warm air, preferably in cocurrent, i.e. in the same direction as the stream of warm air.

Suitable apparatuses for spraying in are single- or multi-substance nozzles and atomizer disks.

The temperature of the stream of warm gas, hereinbelow also referred to as drying gas, is typically in the range of from 50 to 200° C., in particular in the range of from 70 to 180° C. and specifically in the range of from 100 to 160° C. upon entering into the drying apparatus. When the drying gas leaves the drying apparatus, its temperature is typically in the range of from 40 to 120° C. and in particular in the range of from 60 to 100° C. Suitable drying gases are, besides air, in particular inert gases such as nitrogen, argon or helium, with nitrogen being preferred. In the case of readily volatile solvents, it is also possible to employ lower temperatures, for example room temperature.

Typically, spray-drying is effected in spray-drying towers which are suitable for this purpose. Here, the solution(s) or dispersion(s) to be dried and the drying gas are typically introduced into the tower at the top. At the bottom of the tower, the dry active substance particles are discharged together with the gas stream and separated from the gas stream in apparatuses which are arranged downstream, such as cyclones. Besides conventional spray-drying, it is also possible to perform an agglomerating spray-drying operation using an internal or external fluidized bed (for example what is known as the FSD technology from Niro), where the particles formed agglomerate to give larger bodies. The primary particle size of the particles formed is, however, preferably in the abovementioned ranges and will in particular not exceed 100 μm and specifically 50 μm.

If appropriate, the particles, in particular when they have a certain tackiness, will be provided with traditional spray-drying adjuvants. These are finely divided solids which are introduced into the spray-drying apparatus together with the solution(s) or dispersion(s) and which ensure that no agglutination or clumping takes place. Suitable finely divided solids are in particular silicas including hydrophobicized silica, alkali metal and alkaline earth metal silicates, alkaline earth metal alumosilicates, highly crosslinked polyvinylpyrrolidone, celluloses, starches, highly crosslinked sodium carboxymethyl starch or crosslinked sodium carboxymethylcellulose. The particle size of these substances is typically below 100 μm ($D_{90}$ value).

The compositions of the invention can be used in any application, where enzymes are required. The composition of the invention are particularly suitable for incorporation into compositions containing protein hostile substances, e.g. into detergent compositions, in particular into liquid compositions containing protein hostile substances such as liquid detergent compositions.

Therefore, the present invention relates to detergent compositions, containing at least one enzyme compositions as described herein.

The present invention also relates to liquid compositions, in particular liquid detergent compositions, containing at least one enzyme compositions as described herein.

In the detergent compositions of the invention the polymer P protects the enzyme until the detergent is introduced into wash liquor, where the is diluted sufficiently for the particle to dissolve and release the enzyme, so that it is available to act on stains.

The liquid composition of the present composition can be any liquid composition which is suitable to comprise the particles of the invention. The liquid composition may be any composition, but particularly suitable compositions are personal care compositions, cleaning compositions, textile processing compositions e.g. bleaching, pharmaceutical compositions, leather processing compositions, fuel, pulp or paper processing compositions, food and beverage compositions and animal feed compositions.

In a further particular embodiment of the present invention the liquid composition is a liquid detergent composition. In a more particular embodiment of the present invention the liquid composition is a laundry or a dishwashing detergent composition.

In a particular embodiment of the present invention the liquid composition comprises less than 50% water. In a more particular embodiment the liquid composition comprises less than 30% water. In a further embodiment of the present invention the liquid composition comprises less than 20% water.

If the liquid composition is a liquid detergent composition, the liquid composition may comprise a surfactant desolubilising electrolyte, said electrolyte being present in a concentration at which said surfactant forms a structure capable of stably suspending the enzyme/polymer particles.

The liquid detergent composition comprise in a particular embodiment between 30% to 70% of water by weight of the liquid detergent. In a more particular embodiment the liquid detergent comprise between 40% to 60% of water by weight of liquid detergent. In a most particular embodiment the liquid detergent comprises between 80% to 90% of water by weight of liquid detergent.

In a particular embodiment of the present invention the liquid detergent composition comprises more than 30% water but less than 90%. The amount of water comprised in the liquid detergent composition is particularly less than 85%, more particularly less than 75%, such as less than 60% by weight of the liquid detergent.

Liquid detergent compositions according to the invention are conventional compositions normally used in laundry or dishwashing applications.

In a particular embodiment the composition comprises an effective amount of a detergent builder. Suitable builders include condensed phosphates, especially sodium tripolyphosphate or, less preferably, sodium pyrophosphate or sodium tetraphosphate, sodium metaphosphate, sodium carbonate, sodium silicate, sodium orthophosphate, sodium citrate, sodium nitrilotriacetate, a phosphonate such as sodium ethylenediamine tetrakis (methylene phosphonate), sodium diethylenetriamine pentakis (methylene phosphonate), sodium aceto diphosphonate or sodium aminotris (methylene phosphonate), sodium ethylenediamine tetraacetate or a zeolite. Other less preferred builders include potassium or lithium analogues of the above sodium salts. The proportion of builder is typically from about 5% to about 40% by weight of the liquid detergent composition, usually 10% to 35%, preferably 15-30%, more preferably 18 to 28%, most preferably 20 to 27%. Mixtures of two or more builders are often employed, e.g. sodium tripolyphosphate with sodium silicate and/or sodium carbonate and/or with zeolite; or sodium nitrilotriacetate with sodium citrate. Preferably the builder is at least partly present as solid particles suspended in the composition.

The invention is also applicable to the preparation of unbuilt cleaning compositions or compositions in which all the builder is present in solution.

The detergent composition of the invention comprises in a particular embodiment one or more surfactants, which may be non-ionic including semi-polar and/or anionic and/or cationic and/or zwitterionic. Generally, the surfactant will be present in the liquid composition in an amount from about 0.1% to 90% by weight of the composition. In a particular embodiment the surfactant will be present in the liquid composition in an amount from about 10% to 60% by weight of the composition. In another particular embodiment the surfactant will be present in the liquid composition in an amount from about 2 to 35% by weight of the composition.

When included therein the detergent will usually contain from about 1% to about 40% of an anionic surfactant such as linear alkyl benzene sulfonate such as toluene sulfonate, octylbenezene sulfonate or dodecylbenzene sulfonate, alpha-olefin sulfonate, alkyl sulfate (fatty alcohol sulfate), alcohol ethoxysulfate, secondary alkanesulfonate, alpha-sulfo fatty acid methyl ester, alkyl- or alkenyl-succinic acid, dialkyl- or dialkenyl-sulfo-succinic acid or soap. Highly preferred anionic surfactants are the linear alkyl benzene sulfonate (LAS) materials. Such surfactants and their preparation are described for example in U.S. Pat. Nos. 2,220,099 and 2,477,383, incorporated herein by reference. Especially preferred are the sodium and potassium linear straight chain alkylbenzene sulfonates, in which the average number of carbon atoms in the alkyl group is from about 11 to 14. Sodium $C_{11}$-$C_{14}$, e.g., $C_{12}$ LAS is especially preferred. Other useful anionic surfactants are described in WO 99/00478, pages 11 through 13, incorporated herein by reference.

When included therein the detergent will usually contain from about 0.2% to about 40% of a non-ionic surfactant. Suitable non-ionic surfactants include reaction products of ethylene oxide and/or propylene oxide with a hydrophobic compound having at least one NH— or OH radical. The non-ionic surfactant will generally have an average hydrophilic-lipophilic balance (HLB) in the range from 8 to 17, preferably from 9.5 to 14, more preferably from 12 to 14. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Suitable non-ionic surfactants include alcohol ethoxylates, in particular alkanol ethoxylates, alkylphenol ethoxylate such as nonylphenol ethoxylate, alkylpolyglycoside, alkyldimethylamineoxide, ethoxylated fatty acid monoethanolamide, fatty acid monoethanolamide, polyhydroxy alkyl fatty acid amide, or N-acyl N-alkyl derivatives of glucosamine ("glucamides"). Such useful non-ionic surfactants are further described in WO 99/0478, pages 13 through 14, incorporated herein by reference. The detergent may also contain ampholytic and/or zwitterionic surfactants. A typical listing of anionic, non-ionic, ampholytic and zwitterionic surfactants is given in U.S. Pat. No. 3,664,961 issued to Norris on May 23, 1972.

Especially preferred nonionic surfactants of this type are the $C_9$-$C_{15}$ primary alcohol ethoxylates containing 2-12 moles of ethylene oxide per mole of alcohol, particularly the $C_{12}$-015 primary alcohols containing 3-8 moles of ethylene oxide per mole of alcohol.

Another class of preferred nonionic surfactants comprises alkyl polyglucoside compounds of general formula $RO(C_nH^{2n}O)_tZ_x$ wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergent are disclosed in EP-BO 070 077, EP 75996 and EP 94118.

In general any surfactant referred to in GB 1,123,846, or in "Surface Active Agents and Detergents" by Schwartz, Perry and Berch, may be used.

Preferably the pH of the liquid detergent composition is alkaline, e.g. above 7.5, especially 7.5 to 12 typically 8 to 11, e.g. 9 to 10.5.

The liquid detergent composition comprise in a particular embodiment dissolved, surfactant-desolubilising electrolyte. Examples include sodium chloride, sodium nitrate, sodium bromide, sodium iodide, sodium fluoride, sodium borate, sodium formate, or sodium acetate, or corresponding potassium salts. In particularly, however, the electrolyte is a salt which is required to perform a useful function in the wash liquor.

In a particular embodiment the concentrations of electrolyte in solution is greater than 3%, such as greater than 5% by weight. In a another embodiment the concentrations of electrolyte in solution are 6 to 20%, especially 7 to 19%, such as 8 to 18%, 9 to 17%, 10 to 16%, e.g. 11 to 15% by weight of electrolyte in solution, based on the weight of the composition. The electrolyte content is preferably adjusted to provide at least three months storage stability at ambient, at 0° C. and at 40° C.

The detergent composition may contain any of the usual minor ingredients such as soil suspending agents (e.g. carboxymethyl cellulose), preservatives such as formaldehyde or tetrakis(hydroxymethyl)phosphonium salts, bentonite clays, or any of the enzymes described herein, protected according to the invention. Where a bleach is to be employed it may be convenient to encapsulate the bleach e.g. with a hydrophilic encapsulant, or in a hydrophobic medium, such as, for instance a silicone or hydrocarbon as described in EP-A-0238216 or GB-A-2200377.

The liquid detergent compositions according to the present invention may also contain 0-65% w/w of chelating agents. Such chelating agents may be selected from the group consisting of amino carboxylates, amino phosphonates, polyfunctionally-substituted aromatic chelating agents, diphosphate, triphosphate, carbonate, citrate, nitrilotriacetic acid, ethylenediaminetetraacetic acid, diethylenetriaminepentaacetic acid, alkyl- or alkenylsuccinic acid, soluble silicates or layered silicates (e.g. SKS-6 from Hoechst) and mixtures thereof. Further chelating agents are described in WO 99/00478.

The enzyme(s) in the liquid detergent may also be stabilized using stabilizing agents in the liquid phase, e.g. a polyol such as propylene glycol or glycerol, a sugar or sugar alcohol, lactic acid, short chained carboxylic acids such as formate or acetate, peptide aldehydes, boric acid, or a boric acid derivative, e.g. an aromatic borate ester, or a phenyl boronic acid derivative such as 4-formylphenyl boronic acid, and the composition may be formulated as described in e.g. WO 92/19709 and WO 92/19708.

Particularly preferred liquid detergents are those containing: long chain (e.g. $C_1$0-14) linear alkyl benzene sulphonates in an amount of 5-12%, long chain alkyl, or alkyl ether, sulphates, e.g. with 0-5 ehtyleneoxy units, in an amount of 0-3%; fatty acid alkanolamides, and/or alcohol ethoxylates having HLB of less than 12 in an amount of 1-5%; mixtures of mono-and di-long chain alkyl phosphates in an amount of 0-3%, e.g. 0.1-1%; sodium tripolyphosphate (preferably prehydrated with from 0.5 to 5% by weight of water) in an amount of 14-30%, e.g. 14-18% or 20-30%; optionally sodium carbonate in an amount of up to 10%, e.g. 5-10% with the total of sodium tripolyphosphate and carbonate being preferably 20-30%; antiredeposition agents such as sodium carboxymethyl cellulose in an amount of 0.05-0.5%; optical brightening agents in an amount of 0.5%-0.5%; chelating agents, e.g. amino phosphonates such as methylene phosphonates of di- and polyamines, especially sodium ethylenediamine tetra[methylene phosphonate] or diethylene triamine hexa[methylene phosphonate] optionally present in an amount of 0.1-15%; together with conventional minor additives such as perfume colouring preservatives, the remainder being water, the percentages being by weight of the total liquid detergent. The liquid detergent may have a pH after dilution to 1% of 6 to 13, preferably 7 to 12, more usually 8 to 11, e.g. 9 to 10.5.

The present invention is further described by the following examples which should not be construed as limiting the scope of the invention.

I. Starting Materials:

Polymers:

P1: Copolymer of maleic acid and $C_{20}$-$C_{24}$ monoolefin (molar ratio 1:1), hydrolyzed, sodium salt, prepared according to EP 412389 (see table 1), K-value 26.8 (1% in $H_2O$).

P2: Terpolymer of maleic acid, Cu-olefin and $C_{20}$-$C_{24}$-olefin (molar ratio 1:0.6:0.4), hydrolized, sodium salt, prepared according to EP 412389 (see table 1), K-value 50.1 (1% in $H_2O$).

P3: Terpolymer of maleic acid, Cu-olefin and styrene (molar ratio 1:0.1:0.9), hydrolized, sodium salt, prepared according to EP 412389 (see table 1), K-value 52.6 (1% in $H_2O$).

P4: Quaterpolymer of maleic acid, $C_{12}$-olefin, polyisobutene ($M_n$ 550) and styrene (molar ratio 1:0.6:0.2:0.2), hydrolized, sodium salt, prepared according to EP 412389 (see table 1), K-value 28.1 (1% in $H_2O$).

P5: Terpolymer of maleic acid, $C_{20}$-$C_{24}$-olefin and styrene (molar ratio 1:0.7:0.3), hydrolized, sodium salt, prepared according to EP 412389 (see table 1), K-value 65.2 (1% in $H_2O$).

P6: Terpolymer of maleic acid, $C_{20}$-$C_{24}$-olefin and acrylic acid (molar ratio 1:1:0.5), hydrolized, sodium salt, prepared according to EP 412389 (see table 1), K-value 38.9 (1% in $H_2O$).

P7: Quaterpolymer of maleic acid, $C_{12}$-olefin, $C_{20}$-$C_{24}$-olefin and acrylic acid (molar ratio 1:0.5:0.5:0.5), hydrolized, sodium salt, prepared according to EP 412389 (see table 1), K-value 57.1 (1% in $H_2O$).

P8: Copolymer of maleic acid and $C_{16}$-olefin (molar ratio 1.15:1), hydrolized, sodium salt, prepared according to EP 412389 but using organic solvent during the polymerization (see table 1), K-value 10.8 (1% in $H_2O$).

P9: Terpolymer of maleic acid, $C_{12}$-olefin and polyisobutene ($M_n$ 550) (molar ratio 1:0.8:0.2), hydrolized, sodium salt, prepared according to EP 412389 (see table 1), K-value 42.4 (1% in $H_2O$).

P10: Terpolymer of 2-ethylhexyl acrylate, tert.-butylmethacrylate and acrylic acid (weight ratio 0.46:0.15:0.39), prepared according to EP 07115644.2.

P11: Copolymer of crotonic acid and vinyl acetate (weight ratio 10:90), K-value 37 (1% in tetrahydrofurane).

P12: Terpolymer of maleic acid, $C_{18}$ monoolefin and isobutene (molar ratio 1:0.05:0.7), hydrolyzed, sodium salt, prepared according to EP 412389.

P13: Copolymer of ethylene and methacrylic acid (weight ratio 92:8), potassium salt, aqueous emulsion, prepared according to PCT/EP 2007/062189.

P14: Copolymer of maleic acid and $C_{16}$-olefin (molar ratio 1:1), hydrolized, sodium salt, prepared according to EP 412389 (see table 1), K-value 60.4 (1% in $H_2O$).

P15: Copolymer of maleic acid and olefin, hydrolized, sodium salt, Sokalan CP9 (k-value 40, Mw 12000).

P16: Copolymer of styrene, alpha-methyl styrene and acrylic acid (acid number 220 mg KOH/g, Mw 6000), aqueous solution of the ammonium salt.

P17: Copolymer of styrene and acrylic acid, aqueous solution of the potassium salt, Joncryl®HPD 296 with KOH.

P18: Copolymer of styrene and acrylic acid (acid number 110 mg KOH/g, Mw 4500), aqueous solution neutralized with dimethyl ethanol amine.

P19: Copolymer of ethyl acrylate and acrylic acid (weight ratio 0.9:0.10).

P20: Copolymer of ethylene and methacrylic acid (weight ratio 73:27), neutralized with dimethyl ethanol amine, aqueous emulsion, prepared according to PCT/EP 2007/062189.

P21: Terpolymer of maleic acid and Cm-olefin and styrene (molar ratio 1:0.5:1), hydrolized, sodium salt, prepared according to EP 412389 (see table 1), K-value 33.5 (1% in $H_2O$).

P22: Terpolymer of maleic acid, $C_{20}$-$C_{24}$-olefin and 2-ethylhexyl acrylate (molar ratio 1:0.75:0.75), hydrolized, sodium salt, prepared according to EP 412389 (see table 1), K-value 19.7 (1% in $H_2O$)

P23: Terpolymer of tert.-butylacrylamide, ethyl acrylate and acrylic acid, K-value 40 (1% in ethanol), acid number 77 mg KOH/g).

P24: Sodium salt of a modified copolymer of maleic acid and styrene (molar ratio 1:1), modified with a polyetheleneoxide having a Mn of 500, prepared according to the process described in WO 93/17310.

The copolymers of maleic acid with hydrophobic comonomers (polymers P1 to P9, P12, P14, P21 and P22) were prepared by analogy to the method described for dispersion I EP 412389.

TABLE 1

| Polymer | MSA [mol] | Monomer 1 type | mol | Monomer 2 type | mol | Monomer 3 type | mol |
|---|---|---|---|---|---|---|---|
| P1 | 1 | $C_{20}$-$C_{24}$-Olefin | 1 | — | 0 | — | 0 |
| P2 | 1 | $C_{12}$-Olefin | 0.6 | $C_{20}$-$C_{24}$-Olefin | 0.4 | — | 0 |
| P3 | 1 | $C_{12}$-Olefin | 0.1 | styrene | 0.9 | — | 0 |
| P4 | 1 | $C_{12}$-Olefin | 0.6 | styrene | 0.2 | PIB 550 | 0.2 |
| P5 | 1 | $C_{20}$-$C_{24}$-Olefin | 0.7 | styrene | 0.3 | — | 0 |
| P6 | 1 | $C_{20}$-$C_{24}$-Olefin | 1 | Acrylic acid | 0.5 | — | 0 |
| P7 | 1 | $C_{12}$-Olefin | 0.5 | $C_{20}$-$C_{24}$-Olefin | 0.5 | Acrylic acid | 0.5 |
| P8 | 1 | $C_{16}$-Olefin | 0.9 | — | 0 | — | 0 |
| P9 | 1 | $C_{16}$-Olefin | 0.8 | PIB 550 | 0.2 | — | 0 |
| P12 | 1 | $C_{18}$-Olefin | 0.05 | isobutene | 0.7 | | |
| P14 | 1 | $C_{16}$-Olefin | 1.0 | — | 0 | — | 0 |
| P21 | 1 | $C_{18}$-Olefin | 0.5 | styrene | 1 | — | 0 |
| P22 | 1 | $C_{20}$-$C_{24}$-Olefin | 0.75 | EHA | 0.75 | — | 0 |

PIB550: reactive polyisobutene having a number average molecular weight $M_n$ of 550
EHA: 2-ethylhexyl acrylate II. Preparation of Enzyme Containing Particles:

Polymer-enzyme particles A (weight ratio polymer/enzyme 2.5:1, general procedure)

159 g aqueous Savinase concentrate (a protease) with 18% solids (50 KNPU/g) was mixed with 1032 g of a 6.9% polymer solution of the respective polymer in water. The polymer to enzyme solids ratio was thus 2.5:1.

The polymer/enzyme solutions were spray-dried using a Mobil Minor (spray dryer from Niro A/S) in top-spray co-current mode using 165°-170° C. as inlet air temperature and 70-75° C. outlet air temperature. The resulting particles had a particle size of 2-10 microns.

Polymer-enzyme particles B (weight ratio polymer/enzyme 5:1)

The particles were prepared by the general procedure described for polymer-enzyme particles A, using a mixture of 80 g aqueous Savinase concentrate (a protease) with 18% solids (50 KNPU/g) and 913 g of a 7.9% polymer solution of the respective polymer in water. The resulting particles had a particle size of 2-10 microns.

Polymer-enzyme particles C (weight ratio polymer/enzyme 10:1)

The particles were prepared by the general procedure described for polymer-enzyme particles A, using a mixture of 50 g aqueous Savinase concentrate (a protease) with 18% solids (50 KNPU/g) and 1191 g of a 7.6% polymer solution of the respective polymer in water. The resulting particles had a particle size of 2-10 microns.

III. Application Properties of Enzyme Containing Particles:

a) Detergent Base:

Three liquid detergents were prepared according to the composition given in table 2.

TABLE 2

| Component | Composition | | |
|---|---|---|---|
| | Detergent D1 % w/w | Detergent D2 % w/w | Detergent D3 % w/w |
| Sodium alkylethoxy sulphate ($C_{9-15}$, 2EO) | 0.0 | 6.0 | 6.0 |
| Sodium lauryl sulphate | 17.0 | 0.0 | 0.0 |
| Sodium dodecyl benzene sulphonate | 0.0 | 3.0 | 3.0 |
| Sodium toluene sulphonate | 3.0 | 3.0 | 3.0 |
| Oleic acid | 10.0 | 2.0 | 2.0 |
| Primary alcohol ethoxylate ($C_{12-15}$, 7EO) | 5.0 | 3.0 | 3.0 |
| Primary alcohol ethoxylate ($C_{12-15}$, 3EO) | 4.0 | 2.5 | 2.5 |
| Ethanol | 3.0 | 0.5 | 0.5 |
| Monopropylene glycol | 0.0 | 2.0 | 2.0 |
| Tri-sodium citrate $2H_2O$ | 4.5 | 4.0 | 4.0 |
| Triethanolamine | 0.0 | 0.4 | 0.4 |
| Sodium carbonate | 0.5 | 0.0 | 0.0 |
| Sodium sulphate | 0.0 | 2.5 | 0.0 |
| De-ionized water | Ad 100% | Ad 100% | Ad 100% |
| pH adjusted to (with NaOH) | 9.0 | 8.5 | 8.5 |

Detergent composition 4 was the commercial liquid detergent "Non Bio Persil Small&Mighty (2× concentrated)"

Detergent composition 5 was the commercial liquid detergent "TESCO Non Bio Super Concentrated (×2 concentrated)"

b) Storage Stability in Detergent:

The residual Savinase activity of the emzyme-polymer particles in the detergent was measured after storage in closed glasses. Protease activity was measured by a standard protease assay based on the hydrolysis of N,N-dimethylcasein at 40° C. and pH 8.3. As an unprotected protease reference Savinase concentrate was used. The results are summarized in tables 3 to 5.

Dosage of enzyme preparations in the detergents:

Savinase concentrate: 0.15% w/w 2.5:1 polymer:enzyme particles: 0.1% w/w

5:1 polymer:enzyme particles: 0.2% w/w

10:1 polymer:enzyme particles: 0.4% w/w

TABLE 3

Storage stability in detergent D1 after 1 week at 35° C.:

| Example | Polymer enzyme particles | | | % residual protease activity |
|---|---|---|---|---|
| | Type | Polymer | Enzyme:Polymer ratio | |
| Comp. 1 | Savinase concentrate | — | — | 35 |
| 1 | A | P1 | 1:2.5 | 71 |
| 2 | B | P1 | 1:5 | 86 |
| 3 | B | P2 | 1:5 | 53 |
| 4 | B | P3 | 1:5 | 87 |
| 5 | B | P4 | 1:5 | 55 |
| 6 | B | P5 | 1:5 | 60 |
| 7 | B | P6 | 1:5 | 65 |
| 8 | B | P7 | 1:5 | 55 |

TABLE 3-continued

Storage stability in detergent D1 after 1 week at 35° C.:

| Example | Polymer enzyme particles | | | % residual protease activity |
|---|---|---|---|---|
| | Type | Polymer | Enzyme:Polymer ratio | |
| 9 | B | P8 | 1:5 | 73 |
| 10 | B | P9 | 1:5 | 50 |
| 11 | C | P1 | 1:10 | 84 |
| 12 | C | P10 | 1:10 | 63 |
| 13 | C | P11 | 1:10 | 53 |
| 14 | C | P12 | 1:10 | 77 |

TABLE 4

Storage stability in detergent D2 after 1 week at 40° C.:

| Example | Polymer enzyme particles | | | % residual protease activity |
|---|---|---|---|---|
| | Type | Polymer | Enzyme:Polymer ratio | |
| Comp. 2 | Savinase concentrate | — | — | 6 |
| 15 | C | P13 | 1:10 | 64 |
| 16 | C | P14 | 1:10 | 60 |
| 17 | C | P15 | 1:10 | 15 |
| 18 | C | P16 | 1:10 | 27 |
| 19 | C | P17 | 1:10 | 29 |
| 20 | C | P18 | 1:10 | 38 |
| 21 | C | P19 | 1:10 | 52 |
| 22 | C | P20 | 1:10 | 27 |
| 23 | C | P23 | 1:10 | 67 |
| 24 | C | P24 | 1:10 | 15 |

TABLE 5

Storage stability in detergent D3 after 1 week at 40° C.

| Example | Polymer enzyme particles | | | % residual protease activity |
|---|---|---|---|---|
| | Type | Polymer | Enzyme:Polymer ratio | |
| Comp. 2 | Savinase concentrate | — | — | 3 |
| 25 | C | P13 | 1:10 | 16 |
| 26 | C | P14 | 1:10 | 20 |

It is clear from the data that polymer enzyme particles containing Savinase significantly increases the stability of the protease compared to un-stabilized protease.

EXAMPLES 27 TO 29

The particles were prepared as described in I for polymer-enzyme particles C using a Minispray 295 (spray dryer from Büchi, Switzerland) in top-spray co-current mode. The inlet air temperature was 160°-165° C. and the outlet air temperature was 75-80° C. The solution for spray drying was prepared as follows: 2,5 g aqueous Savinase concentrate (a protease) with 18% solids (50 KNPU/g) was mixed with 45 g of a 10% by weight polymer solution of the respective polymer in water. To this mixture a solution of 0.5 g of calcium formate dissolved in 10 g water was added. The resulting mixture was stirred for 30 minutes. The particles obtained by spray drying had a particles size of below 50 μm.

The thus obtained polymer-enzyme particles were tested with regard to their storage stability as described before. The results are summarized in Table 6:

TABLE 6

Storage stability in detergent D2 after 1 week at 40° C.:

| Example | Polymer enzyme particles Type | Polymer | Enzyme:Polymer ratio | % residual protease activity |
|---|---|---|---|---|
| Comp. 2 | Savinase concentrate | — | — | 21 |
| 27 | C | P13 | 1:10 | 64 |
| 28 | C | P14 | 1:10 | 60 |
| 29 | C | P8 | 1:10 | 67 |

EXAMPLES 30 TO 31

The particles were prepared as described in I for polymer-enzyme particles C. The solution for spray drying was prepared as follows: 50 g aqueous Savinase concentrate with 18% solids (50 KNPU/g) was mixed with 900 g of a 10% by weight polymer solution of the respective polymer in water. To this mixture a solution of 10 g of calcium formate dissolved in 200 g water was added. The resulting mixture was stirred for 30 minutes. The particles obtained by spray drying had a particles size of below 50 μm.

The thus obtained polymer-enzyme particles were tested in commercial detergents with regard to their storage stability as described before. The results are summarized in table 7:

TABLE 7

Storage stability in detergent D4 or D5 after 1 week at 40° C.:

| Example | Polymer enzyme particles Type | Polymer | Enzyme:Polymer ratio | % residual protease activity in D4 | % residual protease activity in D5 |
|---|---|---|---|---|---|
| Comp. 2 | Savinase concentrate | — | — | 65 | 3 |
| 30 | C | P1 | 1:10 | 96 | 50 |
| 31 | C | P13 | 1:10 | 83 | 41 |

IV. Washing Properties of a Liquid Detergent Containing Enzyme-Polymer Particle of Example 30 in Comparison with a Liquid Detergent Containing Savinase Concentrate The washing was performed in a Mini Terg-o-tometer wash using EMPA 117 swatches (The Mini-Terg-O-Tometer is a small-scale version of the Terg-O-Tometer test washing machine described in Jay C. Harris, "Detergency Evaluation and Testing," Interscience Publishers Ltd. (1954) pp. 60-61).

The following washing conditions were used:

100 ml wash liquor in 250 ml beakers;

Detergent: D1, dosage: 5 g/l wash liquor, containing a certain amount of savinase concentrate or polymer enzyme particles as given in table 8 as mg enzyme per liter of wash liquor;

Temperature: 35° C.;

Wash time: 15 minutes;

Water hardness: 6°dH;

Swatches: EMPA 117 (two swatches per wash);

After the wash swatches are measured on Macbeth Color Eye 7000 spectrophotometer at remission 460 nm (reflectance). A higher reflectance indicates better washing properties. The results are summarized in table 8:

TABLE 8

Results of the washing tests (reflectance)

| Enzyme | Swatch | mg enzyme protein per liter wash liquor 0.0 | 0.1 | 0.2 | 0.3 | 0.5 | 0.8 |
|---|---|---|---|---|---|---|---|
| Savinase concentrate | #1 | 33.85 | 44.12 | 45.00 | 46.77 | 47.15 | 47.06 |
| Savinase concentrate | #2 | 34.51 | 43.66 | 45.47 | 45.78 | 46.18 | 47.42 |
| Enzyme polymer particles (Example 30) | #1 | 33.23 | 44.38 | 45.50 | 46.06 | 47.15 | 46.41 |
| Enzyme polymer particles (Example 30) | #2 | 33.37 | 44.72 | 46.03 | 46.89 | 46.76 | 46.45 |

There is no significant difference on the wash performance using Savinase concentrate and polymer enzyme particles example 30, showing that the enzyme is released from the particles and performing during wash.

We claim:

1. A detergent composition, which is a liquid detergent composition and comprises an enzyme composition comprising enzyme particles, wherein the particles comprise i) at least one enzyme, and ii) at least one polymer P, where the polymer P is a copolymer having a C—C-backbone, wherein the C—C-backbone carries carboxyl groups, which may be present in the acidic form or in the neutralized form, and wherein the C—C-backbone polymer P comprises at least 20% by weight, based on the total weight of the polymer P, of hydrophobic repeating units derived from a monomer B, wherein volume average particle diameter of the enzyme particles is from 50 nm to 100 μm, wherein polymer P comprises a) a polymerized unit A of at least one monoethylenically unsaturated $C_3$-$C_8$mono-or dicarboxylic acid (monomer A), wherein the polymerized unit A is a unit of polymerized monoethylenically unsaturated $C_3$-$C_8$-mono- or dicarboxylic acid selected from the group consisting of methacrylic acid, maleic acid, itaconic acid, crotonic acid, and a mixture thereof; and b) a polymerized unit B of monomer B, wherein monomer B has a water solubility of at most 30 g/l at 25° C. and comprises a $C_2$-$C_{50}$-olefin, or a combination of a $C_2$-$C_{50}$-olefin with at least one additional monomer B selected from the group consisting of a vinylaromatic compound, a $C_2$-$C_{50}$-alkylester of $C_3$-$C_8$-monocarboxylic acid, bis-$C_1$-$C_{50}$-alkylester of $C_4$-$C_8$-dicarboxylic acid, N—$C_2$-$C_{50}$-alkylamide of $C_3$-$C_8$-monocarboxylic acid, N—$C_1$-$C_{50}$-alkyl-N—$C_1$-$C_{50}$-alkylamide of $C_3$-$C_8$-monocarboxylic acid, vinylester of $C_2$-$C_{50}$-alkanoic acid, vinyl-$C_1$-$C_{40}$-alkylether, N—$C_1$-$C_{40}$-alkylimide of maleic acid, and a mixture thereof wherein polymerized unit A is in a molar amount relative to monomer B from 1:20 to 10:1.

2. The composition according to claim 1, wherein the polymerized unit A comprises a unit of polymerized maleic acid.

3. The composition according to claim 1, wherein the polymerized unit B is a unit of polymerized monomer B having a water solubility of at most 10 g/l at 25° C.

4. The composition according to claim 1, wherein the amount of hydrophobic repeating units in the polymer P is from 40 to 95% by weight of the polymer P.

5. The composition according to claim 1, wherein the polymer P has an acid number in the range from 10 to 700 mg KOH per gram of polymer P.

6. The composition according to claim 1, wherein the weight ratio of enzyme to polymer P is from 1:50 to 10:1.

7. The composition according to claim 1, wherein volume average particle diameter of the enzyme containing particles is from 50 nm to 90 μm.

8. The composition according to claim 1, wherein the at least one enzyme and the at least one polymer P make up at least 50% of the enzyme containing particles.

9. The composition according to claim 1, wherein the enzyme is a proteolytic enzyme.

10. The composition according to claim 1,further comprising at least one bivalent metal cation selected from the group consisting of $Zn^{2+}$, $Mg^{2+}$, $Ca^{2+}$ and mixtures thereof in the form of one or more salts of said cations.

11. The composition according to claim 1, wherein the enzyme composition obtained by a process comprising spray drying a liquid composition comprising the at least one enzyme and the at least one polymer P.

* * * * *